United States Patent [19]

Forsberg et al.

[11] Patent Number: 4,956,028

[45] Date of Patent: Sep. 11, 1990

[54] EXPLOSIVE COMPOSITIONS

[75] Inventor: John W. Forsberg, Mentor-on-the-Lake, Ohio; John J. Mullay, Hazleton; Joseph A. Sohara, Whitehall, both of Penn.

[73] Assignee: The Lubrizol Corporation, Wickliffe, Ohio

[21] Appl. No.: 367,185

[22] Filed: Jun. 16, 1989

Related U.S. Application Data

[63] Continuation of Ser. No. 931,377, Nov. 14, 1986, Pat. No. 4,840,687.

[51] Int. Cl.[5] ..... C06B 45/00

[52] U.S. Cl. ..... 149/2; 149/21; 149/36; 149/46; 149/43; 149/61; 149/74

[58] Field of Search ..... 149/2, 46, 74, 36, 21, 149/43, 61

[56] References Cited

U.S. PATENT DOCUMENTS

| | | | |
|---|---|---|---|
| 2,345,199 | 3/1944 | Hodson | 252/19 |
| 3,027,324 | 3/1962 | Rosenberg | 252/8.5 |
| 3,047,493 | 7/1962 | Rosenberg | 252/8.5 |
| 3,161,551 | 12/1964 | Egly et al. | 149/46 |
| 3,212,945 | 10/1965 | Berthmann et al. | 149/51 |
| 3,216,936 | 11/1965 | Le Suer | 252/32.7 |
| 3,219,666 | 11/1965 | Norman et al. | 260/268 |
| 3,269,946 | 8/1966 | Wiese | 252/32.5 |
| 3,281,356 | 10/1966 | Coleman | 252/32.7 |
| 3,311,558 | 3/1967 | Prizer et al. | 252/47.5 |
| 3,311,561 | 3/1967 | Anderson et al. | 252/75 |
| 3,364,001 | 1/1968 | Drummond et al. | 44/71 |
| 3,378,494 | 4/1968 | Berger | 252/77 |
| 3,390,082 | 6/1968 | Le Suer et al. | 252/32.7 |
| 3,397,097 | 8/1968 | Ataden et al. | 149/46 |
| 3,442,727 | 5/1969 | Thornton | 149/46 |
| 3,447,978 | 6/1969 | Bluhm | 149/2 |
| 3,447,979 | 6/1969 | Bluhm et al. | 149/19 |
| 3,453,155 | 7/1969 | Sheeran et al. | 149/5 |
| 3,459,608 | 8/1969 | Ludolphy et al. | 149/56 |
| 3,541,012 | 11/1970 | Stuche | 252/51.5 |
| 3,576,743 | 4/1971 | Widmer et al. | 252/51.5 |
| 3,617,406 | 8/1971 | Young | 149/41 |
| 3,629,119 | 12/1971 | Weaver | 252/77 |
| 3,632,511 | 1/1972 | Liao | 252/51.5 |
| 3,658,707 | 4/1972 | Delafield et al. | 252/51.5 |
| 3,674,578 | 7/1972 | Catrtermale et al. | 149/2 |
| 3,687,644 | 8/1972 | Delafield et al. | 44/56 |
| 3,715,247 | 2/1973 | Wade | 149/21 |
| 3,765,964 | 10/1973 | Wade | 149/2 |
| 3,770,522 | 11/1973 | Tomis | 149/2 |
| 3,794,534 | 2/1974 | Chandler | 149/2 |
| 3,836,470 | 9/1974 | Muller | 252/51.5 |
| 3,836,471 | 9/1974 | Muller | 252/51.5 |
| 3,838,052 | 9/1974 | Miller | 252/56 |
| 3,865,813 | 2/1975 | Gergle | 260/239.3 |
| 3,868,330 | 2/1975 | Meinhardt et al. | 252/33.6 |
| 3,948,800 | 4/1976 | Meinhardt | 252/356 |
| 3,957,854 | 5/1976 | Miller | 260/482 |
| 4,008,108 | 2/1977 | Chrisp | 149/2 |
| 4,010,105 | 3/1977 | Halgado | 252/77 |
| 4,048,080 | 9/1977 | Lee et al. | 252/51.54 |
| 4,053,426 | 10/1977 | Davis et al. | 252/34 |
| 4,098,585 | 7/1978 | Vartanian et al. | 44/63 |
| 4,110,134 | 8/1978 | Wade | 149/2 |
| 4,111,727 | 9/1978 | Clay | 149/2 |
| 4,138,281 | 2/1979 | Olney et al. | 149/2 |
| 4,140,640 | 2/1979 | Scherbal et al. | 252/8.55 |
| 4,141,767 | 2/1979 | Sudweeks et al. | 149/2 |
| 4,149,916 | 4/1979 | Wade | 149/56 |
| 4,149,917 | 4/1979 | Wade | 149/56 |
| 4,181,546 | 1/1980 | Clay | 149/21 |
| 4,185,485 | 1/1980 | Schick et al. | 72/42 |
| 4,216,040 | 8/1980 | Sudweeks et al. | 149/21 |
| 4,218,272 | 8/1980 | Brockington | 149/21 |
| 4,225,447 | 9/1980 | Law et al. | 252/34.7 |
| 4,230,588 | 10/1980 | Bonazza et al. | 252/51.5 |
| 4,231,821 | 11/1980 | Sudweeks et al. | 149/21 |
| 4,233,165 | 11/1980 | Salathiel et al. | 252/8.55 |
| 4,234,435 | 11/1980 | Meinhardt et al. | 252/51.5 |
| 4,248,644 | 2/1981 | Heakly | 149/21 |
| 4,253,974 | 3/1981 | Valcho et al. | 252/8.55 |
| 4,253,975 | 3/1981 | Law et al. | 252/32.7 |
| 4,287,010 | 9/1981 | Owen | 149/2 |
| 4,294,633 | 10/1981 | Clay | 149/2 |
| 4,310,364 | 1/1982 | Ekman et al. | 149/2 |
| 4,315,784 | 2/1972 | Hattori et al. | 149/2 |
| 4,315,787 | 2/1982 | Hattori et al. | 149/2 |

(List continue on next page.)

FOREIGN PATENT DOCUMENTS

| | | |
|---|---|---|
| 0155800 | 9/1985 | European Pat. Off. . |
| 0156572 | 10/1985 | European Pat. Off. . |
| 984409 | 2/1965 | United Kingdom . |
| 1009197 | 11/1965 | United Kingdom . |
| 1020293 | 2/1966 | United Kingdom . |
| 1031130 | 5/1966 | United Kingdom . |
| 1098936 | 1/1968 | United Kingdom . |
| 1206059 | 9/1970 | United Kingdom . |
| 1214245 | 12/1970 | United Kingdom . |
| 1306546 | 2/1973 | United Kingdom . |
| 1335097 | 10/1973 | United Kingdom . |
| 1423876 | 2/1976 | United Kingdom . |
| 1532836 | 11/1978 | United Kingdom . |

(List continued on next page.)

*Primary Examiner*—Steven J. Lechert, Jr.
*Attorney, Agent, or Firm*—Neil A. DuChez; Robert A. Franks; Frederick D. Hunter

[57] ABSTRACT

An explosive composition is disclosed which comprises a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent, (B) at least one polyamine, and (C) at least one acid or acid-producing compound capable of forming at least one salt with said polyamine. These explosive compositions can be water-in-oil emulsions or melt-in-oil emulsions. They can also be explosive compositions derived from such emulsions wherein at temperatures below that at which the emulsion is formed the discontinuous phase is solid or in the form of droplets of supercooled liquid.

53 Claims, No Drawings

U. S. PATENT DOCUMENTS

| | | | |
|---|---|---|---|
| 4,319,784 | 2/1982 | Hattori et al. | 149/2 |
| 4,326,900 | 4/1982 | Hattori et al. | 149/2 |
| 4,329,249 | 5/1982 | Forsberg | 252/34.7 |
| 4,343,663 | 8/1982 | Breza | 149/4 |
| 4,357,184 | 11/1982 | Binet et al. | 149/2 |
| 4,368,133 | 1/1983 | Forsberg | 252/75 |
| 4,383,873 | 5/1983 | Wade et al. | 149/2 |
| 4,391,659 | 7/1983 | Smith | 149/2 |
| 4,394,198 | 7/1983 | Takeuchi et al. | 149/21 |
| 4,404,050 | 9/1983 | Yorke et al. | 149/2 |
| 4,435,297 | 3/1984 | Forsberg | 252/34.7 |
| 4,447,348 | 5/1984 | Forsberg | 252/75 |
| 4,448,619 | 5/1984 | Mitchell | 149/21 |
| 4,448,703 | 5/1984 | Forsberg | 252/75 |
| 4,472,215 | 9/1984 | Binet et al. | 149/109.6 |
| 4,490,194 | 12/1984 | Cooper et al. | 149/2 |
| 4,490,195 | 12/1984 | Cooper et al. | 149/2 |
| 4,496,405 | 1/1985 | Cechinski | 149/2 |
| 4,504,276 | 3/1985 | Baker | 44/51 |
| 4,525,225 | 6/1985 | Cechenski | 149/19.5 |
| 4,554,032 | 11/1985 | Hattori et al. | 149/21 |
| 4,555,278 | 11/1985 | Cescon et al. | 149/21 |
| 4,615,751 | 10/1986 | Smith et al. | 149/2 |
| 4,708,753 | 11/1987 | Forsberg | 149/2 |
| 4,710,248 | 12/1987 | Yates et al. | 149/21 |
| 4,772,739 | 9/1988 | Forsberg | 558/208 |
| 4,822,433 | 4/1989 | Cooper | 149/2 |
| 4,828,633 | 5/1989 | Forsberg | 149/2 |
| 4,840,687 | 6/1989 | Forsberg et al. | 149/2 |
| 4,844,756 | 7/1989 | Forsberg | 149/2 |

FOREIGN PATENT DOCUMENTS

| | | |
|---|---|---|
| 1538092 | 1/1979 | United Kingdom . |
| 1557917 | 12/1979 | United Kingdom . |
| 2042495 | 9/1980 | United Kingdom . |
| 2058740 | 4/1981 | United Kingdom . |

EXPLOSIVE COMPOSITIONS

This is a continuation of U.S. application Ser. No. 931,377, filed Nov. 14, 1986, now U.S. Pat. No. 4,840,687, which is incorporated herein by reference in its entirety.

TECHNICAL FIELD

This invention relates to explosive compositions and, more particularly, to water-in-oil explosive emulsions and melt-in-oil explosive emulsions containing at least one nitrogen-containing emulsifier derived from (A) at least one carboxylic acylating agent, (B) at least one polyamine, and (C) at least one acid or acid-producing compound capable of forming at least one salt with said polyamine.

BACKGROUND OF THE INVENTION

Water-in-oil explosive emulsions typically comprise a continuous organic phase and a discontinuous oxidizer phase containing water and an oxygen-supplying source such as ammonium nitrate, the oxidizer phase being dispersed throughout the continuous organic phase. Examples of such water-in-oil explosive emulsions are disclosed, inter alia, in U.S. Pat. Nos. 3,447,978; 3,765,964; 3,985,593; 4,008,110; 4,097,316; 4,104,092; 4,110,134; 4,149,916; 4,149,917; 4,218,272; 4,259,977; 4,357,184; 4,371,408; 4,391,659; 4,404,050; 4,409,044; 4,448,619; 4,453,989; and 4,534,809; U.K. Patent Application GB No. 2,050,340A; and European Application Publication Nos. 0,155,800 and 0,156,572; these patents and applications being incorporated herein by reference.

Melt-in-oil explosive emulsions (sometimes referred to in the art as melt-in-fuel explosive emulsions) are similar to water-in-oil explosive emulsions with the exception that the water in the discontinuous oxidizer phase has been eliminated or reduced to a low level (e.g., less than about 5% by weight of the total weight of the oxidizer phase). Examples of melt-in-oil explosive emulsions are disclosed in U.S. Pat. Nos. 4,248,644; 4,548,659; and 4,552,597; and European Application Publication No. 0,155,800; said patents and application being incorporated herein by reference.

Formation of these water-in-oil and melt-in-oil explosive emulsions is generally effected in the presence of an emulsifier which is selected to promote subdivision of the droplets of the oxidizer phase and dispersion thereof in the continuous organic phase. While many of the emulsifiers described in the prior art are meritorious, none have provided emulsion stability characteristics that are entirely satisfactory. Additionally, with most emulsifiers used in the prior art, selection of the fuel or oil for the continuous organic phase is generally limited to highly-refined, highly paraffinic oils such as white oils.

Hydrocarbyl-substituted carboxylic acylating agents having at least about 30 aliphatic carbon atoms in the substituent are known. Examples of such acylating agents include the polyisobutenyl-substituted succinic acids and anhydrides. The use of such carboxylic acylating agents as additives in normally liquid fuels and lubricants is disclosed in U.S. Pat. Nos. 3,288,714 and 3,346,354. These acylating agents are also useful as intermediates for preparing additives for use in normally liquid fuels and lubricants as described in U.S. Pat. Nos. 2,892,786; 3,087,936; 3,163,603; 3,172,892; 3,189,544; 3,215,707; 3,219,666; 3,231,587; 3,235,503; 3,272,746; 3,306,907; 3,306,908; 3,331,776; 3,341,542; 3,346,354; 3,374,174; 3,379,515; 3,381,022; 3,413,104; 3,450,715; 3,454,607; 3,455,728; 3,476,686; 3,513,095; 3,523,768; 3,630,904; 3,632,511; 3,697,428; 3,755,169; 3,804,763; 3,836,470; 3,862,981; 3,936,480; 3,948,909; 3,950,341; 4,234,435; and 4,471,091; and French Pat. No. 2,223,415; these patents being incorporated herein by reference.

U.S. Pat. No. 3,216,936 describes nitrogen-containing dispersants for use in lubricants which are obtained by the reaction of an alkylene amine with an acidic mixture consisting of a hydrocarbon-substituted succinic acid having at least about 50 aliphatic car-bon atoms in the hydrocarbon substituent and an aliphatic monocarboxylic acid. The aliphatic monocarboxylic acids are described as including saturated and unsaturated acids such as acetic acid, dodecanoic acid, oleic acid, naphthenic acid, formic acid, etc. Acids having 12 or more aliphatic carbon atoms, particularly stearic acid and oleic acid, are described as being especially useful.

British Pat. No. 1,162,436 describes ashless dispersant compositions which are useful in lubricating compositions and fuels. The dispersant compositions are prepared by reacting certain specified alkenyl substituted succinimides or succinic amides with a hydrocarbon-substituted succinic acid or anhydride.

U.S. Pat. Nos. 3,639,242 and 3,708,522 describe compositions prepared by post-treating mono- and polycarboxylic acid esters with mono- or polycarboxylic acid acylating agents. The compositions thus obtained are reported to be useful as dispersants in lubricants and fuels.

SUMMARY OF THE INVENTION

The present invention provides for an explosive composition comprising a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent, (B) at least one polyamine, and (C) at least one acid or acid-producing compound capable of forming at least one salt with said polyamine. These explosive compositions can be water-in-oil emulsions or melt-in-oil emulsions. They can also be explosive compositions derived from such emulsions wherein at temperatures below that at which the emulsion is formed the discontinuous phase is solid or in the form of droplets of super-cooled liquid.

DESCRIPTION OF THE PREFERRED EMBODIMENTS

The term "emulsion" as used in this specification and in the appended claims is intended to cover not only water-in-oil emulsions and melt-in-oil emulsions, but also explosive compositions derived from such emulsions wherein at temperatures below that at which the emulsion is formed the discontinuous phase is solid or in the form of droplets of super-cooled liquid.

The term "hydrocarbyl" is used herein to include:

(1) hydrocarbyl groups, that is, aliphatic (e.g., alkyl or alkenyl), alicyclic (e.g., cycloalkyl, cycloalkenyl), aromatic, aliphatic- and alicyclic-substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which will, while having predominantly hydrocarbyl character within the context of this invention, contain other than carbon present in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three non-hydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation; ethylenic unsaturation, when present will generally be such that there is no more than one ethylenic linkage present for every ten carbon-to-carbon bonds. The hydrocarbyl groups are often completely saturated and therefore contain no ethylenic unsaturation.

The term "lower" as used herein in conjunction with terms such as alkyl, alkenyl, alkoxy, and the like, is intended to describe such groups which contain a total of up to 7 carbon atoms.

The continuous organic phase of the explosive compositions of the invention is preferably present at a level in the range of from about 2% to about 15% by weight, more preferably from about 4% to about 8% by weight based on the total weight of said composition. The discontinuous oxidizer phase is preferably present at a level in the range of from about 85% to about 98% by weight, more preferably from about 92% to about 96% by weight based on the total weight of said composition. The nitrogen-containing emulsifier of the invention is preferably present at a level in the range of from about 4% to about 40% by weight, more preferably from about 12% to about 20% by weight based on the total weight of the organic phase.

When such explosive compositions are water-in-oil emulsions, the oxygen-supplying component is preferably present at a level in the range of from about 70% to about 95% by weight, more preferably from about 85% to about 92% by weight, more preferably from about 87% to about 90% by weight based on the total weight of the oxidizer phase. The water is preferably present at a level in the range of about 5% to about 30% by weight, more preferably about 8% to about 15% by weight, more preferably about 10% to about 13% by weight based on the weight of the oxidizer phase.

On the other hand, when the emulsion is a melt-in-oil emulsion, the oxygen-supplying component is preferably present at a level of up to about 100% by weight of the oxidizer phase. The melt-in-oil emulsion may contain some water, but generally only at levels of no more than about 5% by weight of the total weight of the oxidizer phase.

The nitrogen-containing emulsifiers of the invention are formed by the reaction between (A) at least one carboxylic acylating agent, (B) at least one polyamine, and (C) at least one acid or acid-producing compound capable of forming at least one salt with said polyamine.

Reactant (A)

The carboxylic acylating agent may be an aliphatic or aromatic, mono- or polycarboxylic acid or acid-producing compound. These carboxylic acid acylating agents include lower molecular weight carboxylic acids (e.g., carboxylic acids having up to about 18 carbon atoms such as fatty acids having about 10 to about 18 carbon atoms or tetrapropenyl-substituted succinic anhydride) as well as higher molecular weight carboxylic acids. Throughout this specification and in the appended claims, any reference to carboxylic acids as acylating agents is intended to include the acid-producing derivatives such as anhydrides, esters, acyl halides, and mixtures thereof unless otherwise specifically stated.

The nitrogen-containing emulsifiers of this invention are preferably soluble in the organic phase of the inventive explosive compositions, and the number of carbon atoms present in the acylating agent (A) is important in contributing to the desired solubility of these emulsifiers. The sum of the carbon atoms in the reactants (A), (B) and (C) must be sufficient to render the emulsifier hydrocarbon-soluble. Generally, if the acylating agent (A) contains a large number of carbon atoms, the reactants (B) and (C) may be selected from those reactants containing fewer carbon atoms (or no carbon atoms as in the case of, for example, mineral acids). Conversely, if the reactants (B) and/or (C) contain a large number of carbon atoms, the acylating agent (A) can be selected from those agents containing fewer carbon atoms. Usually, in order to provide the desired hydrocarbon solubility, the sum of the carbon atoms in reactants (A), (B) and (C) will total at least about 10 carbon atoms, more preferably at least about 30 carbon atoms, more preferably at least about 50 carbon atoms.

The acylating agent (A) may contain polar substituents provided that the polar substituents are not present in portions sufficiently large to alter significantly the hydrocarbon character of the acylating agent. Typical suitable polar substituents include halo, such as chloro and bromo, oxo, oxy, formyl, sulfenyl, sulfinyl, thio, nitro, etc. Such polar substituents, if present, preferably do not exceed about 10% by weight of the total weight of the hydrocarbon portion of the acylating agent, exclusive of the carboxyl groups.

The lower molecular weight monocarboxylic acids contemplated for use in this invention include saturated and unsaturated acids. Examples of such useful acids include formic acid, acetic acid, chloroacetic acid, propionic acid, butyric acid, acrylic, benzoic acid, butanoic acid, cyclohexanoic, dodecanoic acid, palmitic acid, decanoic acid, oleic acid, lauric acid, stearic acid, myristic acid, linoleic acid, linolenic acid, naphthenic acid, chlorostearic acid, tall oil acid, etc. Anhydrides and lower alkyl esters of these acids can also be used. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference.

Examples of lower molecular weight polycarboxylic acids include dicarboxylic acids and derivatives such as maleic acid, maleic anhydride, chloromaleic anhydride, malonic acid, succinic acid, succinic anhydride, glutaric acid, glutaric anhydride, adipic acid, pimelic acid, azelaic acid, sebacic acid, glutaconic acid, citraconic acid, itaconic acid, allyl succinic acid, cetyl malonic acid, tetrapropylene-substituted succinic anhydride, etc. Lower alkyl esters of these acids can also be used.

Lower molecular weight hydrocarbyl-substituted succinic acid and anhydrides can also be used. Typically, these acylating agents are represented by the formula wherein R* is a $C_1$ to about a $C_{10}$ hydrocarbyl group. Preferably, R* is an aliphatic or alicyclic hydrocarbyl group with less than 10% of its carbon-to-carbon bonds being unsaturated. Examples of such groups include 4-butylcyclohexyl, di(isobutyl), decyl, etc. The production of such substituted succinic acids and their derivatives via alkylation of maleic acid or its derivatives with a halohydrocarbon is well known to those of skill in the art and need not be discussed in detail herein.

Acid halides of the afore-described lower molecular weight mono- and polycarboxylic acids can be used as lower molecular weight acylating agents in this invention. These can be prepared by the reaction of such acids or their anhydrides with halogenating agents such as phosphorus tribromide, phosphorus pentachloride, phosphorus oxychloride or thionyl chloride. Esters of such acids can be prepared simply by the reaction of the acid, acid halide or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

The monocarboxylic acids include isoaliphatic acids, i.e., acids having one or more lower acyclic pendant alkyl groups. Such acids often contain a principal chain having from about 14 to about 20 saturated, aliphatic carbon atoms and at least one but usually no more than about four pendant acyclic alkyl groups. The principal chain of the acid is exemplified by groups derived from tetradecane, pentadecane, hexadecane, heptadecane, octadecane, and eicosane. The pendant group is preferably a lower alkyl group such as methyl, ethyl, n-propyl, isopropyl, n-butyl, isobutyl, tert-butyl, n-hexyl, or other groups having up to about 7 carbon atoms. The pendant group may also be a polarsubstituted alkyl group such as chloromethyl, bromobutyl, methoxyethyl, or the like, but it preferably contains no more than one polar substituent per group. Specific examples of such isoaliphatic acids include 10-methyl-tetradecanoic acid, 11-methyl-pentadecanoic acid, 3-ethyl-hexadecanoic acid, 15-methyl-heptadecanoic acid, 16-methyl-heptadecanoic acid, 6-methyl-octadecanoic acid, 8-methyl-octadecanoic acid, 10-methyloctadecanoic acid, 14-methyl-octadecanoic acid, 16-methyl-octadecanoic acid, 15-ethyl-heptadecanoic acid, 3-chloromethyl-nonadecanoic acid, 7,8,9,10-tetramethyl-octadecanoic acid, and 2,9,10-trimethyloctadecanoic acid.

The isoaliphatic acids includes mixtures of branch-chain acids prepared by the isomerization of commercial fatty acids of, for example, about 16 to about 20 carbon atoms. A useful method involves heating the fatty acid at a temperature above about 250° C. and a pressure between about 200 and 700 psi, distilling the crude isomerized acid, and hydrogenating the distillate to produce a substantially saturated isomerized acid. The isomerization can be promoted by a catalyst such as mineral clay, diatomaceous earth, aluminum chloride, zinc chloride, ferric chloride, or some other Friedel-Crafts catalyst. The concentration of the catalyst may be as low as about 0.01%, but more often from about 0.1% to about 3% by weight of the isomerization mixture. Water also promotes the isomerization and a small amount, from about 0.1% to about 5% by weight, of water may thus be advantageously added to the isomerization mixture. The unsaturated fatty acids from which the isoaliphatic acids may be derived include oleic acid, linoleic acid, linolenic acid, and commercial fatty acid mixtures such as tall oil acids.

The higher molecular weight mono- and polycarboxylic acid acylating agents suitable for use as reactant (A) are well known in the art and have been described in detail, for example, in the following U.S., British and Canadian patents: U.S. Pat. Nos. 3,024,237; 3,087,936; 3,163,603; 3,172,892; 3,215,707; 3,219,666; 3,231,587; 3,245,910; 3,254,025; 3,271,310; 3,272,743; 3,272,746; 3,278,550; 3,288,714; 3,306,907; 3,307,928; 3,312,619; 3,341,542; 3,346,354; 3,367,943; 3,373,111; 3,374,174; 3,381,022; 3,394,179; 3,454,607; 3,346,354; 3,470,098; 3,630,902; 3,652,616; 3,755,169; 3,868,330; 3,912,764; 4,234,435; and 4,368,133; British Pat. Nos. 944,136; 1,085,903; 1,162,436; and 1,440,219; and Canadian Pat. No. 956,397. These patents are incorporated herein by reference.

As disclosed in the foregoing patents, there are several processes for preparing these higher molecular weight acylating agents. Generally, these processes involve the reaction of (1) an ethylenically unsaturated carboxylic acid, acid halide, anhydride or ester reactant with (2) an ethylenically unsaturated hydrocarbon containing at least about 10 aliphatic carbon atoms or a chlorinated hydrocarbon containing at least about 10 aliphatic carbon atoms at a temperature within the range of about 100°-300° C. The chlorinated hydrocarbon or ethylenically unsaturated hydrocarbon reactant preferably contains at least about 20 carbon atoms, more preferably at least about 30 carbon atoms, more preferably at least about 40 carbon atoms, more preferably at least about 50 carbon atoms, and may contain polar substituents, oil-solubilizing pendant groups, and be unsaturated within the general limitations explained hereinabove. It is these hydrocarbon reactants which provide most of the aliphatic carbon atoms present in the acyl moiety of the final products.

When preparing the carboxylic acid acylating agent, the carboxylic acid reactant usually corresponds to the formula $R_o$—$(COOH)_n$, where $R_o$ is characterized by the presence of at least one ethylenically unsaturated carbon-to-carbon covalent bond and n is an integer from 1 to about 6 and preferably 1 or 2. The acidic reactant can also be the corresponding carboxylic acid halide, anhydride, ester, or other equivalent acylating agent and mixtures of one or more of these. Ordinarily, the total number of carbon atoms in the acidic reactant will not exceed about 20, preferably this number will not exceed about 10 and generally will not exceed about 6. Preferably the acidic reactant will have at least one ethylenic linkage in an alpha, beta-position with respect to at least one carboxyl function. Exemplary acidic reactants are acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, and the like. Preferred acid reactants include acrylic acid, methacrylic acid, maleic acid, and maleic anhydride.

The ethylenically unsaturated hydrocarbon reactant and the chlorinated hydrocarbon reactant used in the preparation of these higher molecular weight carboxylic acylating agents are preferably high molecular weight, substantially saturated petroleum fractions and substantially saturated olefin polymers and the corresponding chlorinated products. Polymers and chlorinated polymers derived from mono-olefins having from 2 to about 30 carbon atoms are preferred. Especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

Interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with chloroprene, isobutene with p-methyl-styrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of hydrocarbon solubility, the interpolymers contemplated for use in preparing the acylating agents of this invention are preferably substantially aliphatic and substantially saturated, that is, they should contain at least about 80% and preferably about 95%, on a weight basis, of units derived from aliphatic mono-olefins. Preferably, they will contain no more than about 5% olefinic linkages based on the total number of the carbon-to-carbon covalent linkages present.

In a particularly advantageous embodiment of the invention, the polymers and chlorinated polymers are obtained by the polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes preferably contain predominantly (that is, greater than about 80% of the total repeat units) isobutene repeat units of the configuration.

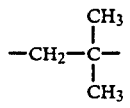

The chlorinated hydrocarbons and ethylenically unsaturated hydrocarbons used in the preparation of the higher molecular weight carboxylic acylating agents can have number average molecular weights of up to about 100,000 or even higher, although preferred acylating agents have molecular weights up to about 10,000, more preferably up to about 7500, more preferably up to about 5000. Preferred acylating agents are those containing hydrocarbyl groups of at least about 10 carbon atoms, preferably at least about 20 carbon atoms, more preferably at least about 30 carbon atoms, more preferably at least about 40 carbon atoms, more preferably at least about 50 carbon atoms.

The higher molecular weight carboxylic acylating agents may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polyhydric alcohol with potassium permanganate, nitric acid, or a similar oxidizing agent. Another method involves the reaction of an olefin or a polar-substituted hydrocarbon such as a chloropolyisobutene with an unsaturated polycarboxylic acid such as 2-pentene-1,3,5-tricarboxylic acid prepared by dehydration of citric acid.

Monocarboxylic acid acylating agents may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

Monocarboxylic and polycarboxylic acid acylating agents can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281, this patent being incorporated herein by reference.

The monocarboxylic and polycarboxylic acid anhydrides can be obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid groups separated by no more than three carbon atoms such as substituted succinic or glutaric acid, whereas linear anhydrides are usually obtained from polycarboxylic acids having the acid groups separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Hydrocarbyl-substituted succinic acids and the anhydride, acid halide and ester derivatives thereof are particularly preferred acylating agents (A). These acylating agents are preferably prepared by reacting maleic anhydride with a high molecular weight olefin or a chlorinated hydrocarbon such as a chlorinated polyolefin. The reaction involves merely heating the two reactants at a temperature in the range of about 100° C. to about 300° C., preferably, about 100° C. to about 200° C. The product from this reaction is a hydrocarbyl-substituted succinic anhydride wherein the substituent is derived from the olefin or chlorinated hydrocarbon. The product may be hydrogenated to remove all or a portion of any ethylenically unsaturated covalent linkages by standard hydrogenation procedures, if desired. The hydrocarbyl-substituted succinic anhydrides may be hydrolyzed by treatment with water or steam to the corresponding acid and either the anhydride or the acid may be converted to the corresponding acid halide or ester by reacting with a phosphorus halide, phenol or alcohol. Preferred hydrocarbyl-substituted succinic acids and anhydrides are represented by the formulae

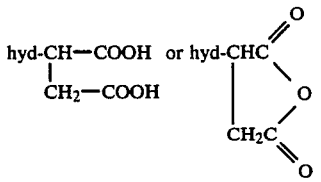

wherein hyd is the hydrocarbyl substituent. Preferably hyd contains at least about 10 carbon atoms, more preferably at least about 20 carbon atoms, more preferably at least about 30 carbon atoms, more preferably at least about 40 carbon atoms, more preferably at least about 50 carbon atoms. The number average molecular weight for hyd will generally not exceed about 100,000, preferably it will not exceed about 10,000, more preferably it will not exceed about 7500, more preferably it will not exceed about 5000.

Although it is preferred that the acylating agent (A) is an aliphatic mono- or polycarboxylic acid, and more preferably a dicarboxylic acid, the carboxylic acylating agent (A) may also be an aromatic mono- or polycarboxylic acid or acid-producing compound. The aromatic acids are preferably mono- and dicarboxy-substituted benzene, naphthalene, anthracene, phenanthrene or like aromatic hydrocarbons. They include also the alkyl-substituted derivatives, and the alkyl groups may contain up to about 30 carbon atoms. The aromatic acid may also contain other substituents such as halo, hydroxy, lower alkoxy, etc. Specific examples of aromatic mono- and polycarboxylic acids and acid-producing compounds useful as acylating agent (A) include benzoic acid, m-toluic acid, salicyclic acid, phthalic acid, isophthalic acid, terephthalic acid, 4-propoxy-benzoic acid, 4-methyl-benzene-1,3-dicarboxylic acid, naphthalene-1,4-dicarboxylic acid, anthracene dicarboxylic acid, 3-dodecyl-benzene-1,4-dicarboxylic acid, 2,5-dibutylbenzene-1,4-dicarboxylic acid, etc. The anhydrides of these dicarboxylic acids also are useful as the carboxylic acylating agent (A).

Reactant (B)

Reactant (B) is at least one polyamine. The polyamines can be primary or secondary amines; the primary amines being characterized by the presence within their structure of at least one $—NH_2$ group, and the secondary amines being characterized by the presence of at least one $>NH$ group.

The polyamines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. These amines may also contain non-hydrocarbon substituents or groups as long as these groups do not significantly interfere with the reaction of such amines with reactants (A) and (C). Such non-hydrocarbon substituents or groups include lower alkoxy, lower alkyl, mercapto, nitro, and interrupting groups such as —O— and —S— (e.g., as in such groups as $$—CH_2CH_2—X—CH_2CH_2—$$

where X is —O— or —S—).

The polyamines include aliphatic, cycloaliphatic and aromatic polyamines analogous to the aliphatic, cycloaliphatic and aromatic monoamines described below except for the presence within their structure of at least one additional amino nitrogen. The additional amino nitrogen can be a primary, secondary or tertiary amino nitrogen. Examples of such polyamines include N-aminopropyl-cyclohexylamine, N-N'-di-n-butyl-para-phenylene diamine, bis-(para-aminophenyl)-methane, 1,4-diaminocyclohexane, and the like.

Aliphatic monoamines include mono-aliphatic and di-aliphatic-substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent, and the like. The total number of carbon atoms in these aliphatic monoamines preferably does not exceed about 40 and usually does not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)ethylamine, benzylamine, phenylethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamines, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines and pyranyl-substituted cyclohexylamine.

Aromatic monoamines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthylene. Examples of aromatic monoamines include aniline, di(-para-methylphenyl) amine, naphthylamine, N-(n-butyl) aniline, and the like. Examples of aliphatic-substituted, cycloaliphatic-substituted, and heterocyclic-substituted aromatic monoamines include para-ethoxyaniline, paradodecylamine, cyclohexyl-substituted naphthylamine and thienyl-substituted aniline.

Heterocyclic polyamines can also be used. As used herein, the terminology "heterocyclic polyamine" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen heteroatom. The 5- and 6-membered heterocyclic rings are preferred.

Among the suitable heterocyclic polyamines are the aziridines, azetidines, azolidines, tetra- and di-hydro pyridines, pyrroles, indoles, piperadines, imidazoles, di- and tetra-hydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, diand perhydroderivatives of each of the above and mixtures of two or more of these heterocyclic amines. Preferred heterocyclic polyamines are the saturated 5- and 6-membered heterocyclic polyamines containing only nitrogen, oxygen and/or sulfur in the hetero ring, especially the piperidines, piperazines, thiomorpholines, morpholines, pyrrolidines, and the like. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

Hydrazine and substituted-hydrazine can also be used. At least one of the nitrogens in the hydrazine must contain a hydrogen directly bonded thereto. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy-substituted phenyl or lower alkyl-substituted phenyl. Specific examples of substituted hydrazines are methylhyydrazine, N,N-dimethylhydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methylhydrazine, N,N'-di-(para-chlorophenol)-hydrazine, N-phenyl-N'-cyclohexylhydrazine, and the like.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene

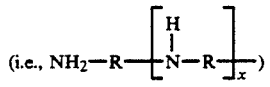

group per nine amino units present on the main chain; for example, 1–4 of such branched chains per nine units on the main chain, but preferably one side chain unit per nine main chain units. Thus, these polyamines contain at least three primary amino groups and at least one tertiary amino group. These amines may be expressed by the formula:

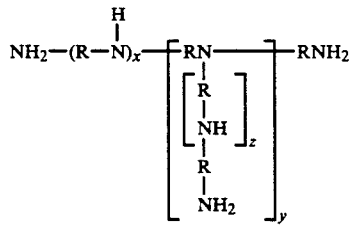

wherein R is an alkylene group such as ethylene, propylene, butylene and other homologs (both straight chained and branched), etc., but preferably ethylene; and x, y and z are integers; x is in the range of from about 4 to about 24 or more, preferably from about 6 to about 18; y is in the range of from 1 to about 6 or more, preferably from 1 to about 3; and z is in the range of from zero to about 6, preferably from zero to about 1. The x and y units may be sequential, alternative, orderly or randomly distributed. A useful class of such polyamines includes those of the formula:

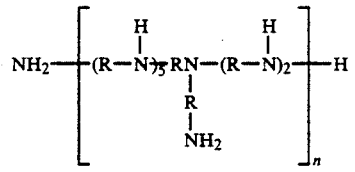

wherein n is an integer in the range of from 1 to about 20 or more, preferably in the range of from 1 to about 3, and R is preferably ethylene, but may be propylene, butylene, etc. (straight chained or branched). Useful embodiments are represented by the formula:

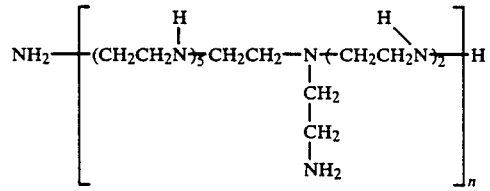

wherein n is an integer in the range of 1 to about 3. The groups within the brackets may be joined in a head-to-head or a head-to-tail fashion. U.S. Pat. Nos. 3,200,106 and 3,259,578 are incorporated herein by reference for their disclosures relative to said polyamines.

Suitable polyamines also include polyoxyalkylene polyamines, e.g., polyoxyalkylene diamines and polyoxyalkylene triamines, having average molecular weights ranging from about 200 to about 4000, preferably from about 400 to 2000. Examples of these polyoxyalkylene polyamines include those amines represented by the formula:

$$NH_2\text{-Alkylene}\text{-}(\text{O-Alkylene})_m\text{-}NH_2$$

wherein m has a value of from about 3 to about 70, preferably from about 10 to about 35; and the formula:

$$R\text{-}[\text{Alkylene}\text{-}(\text{O-Alkylene})_n\text{-}NH_2]_{3-6}$$

wherein n is a number in the range of from 1 to about 40, with the proviso that the sum of all of the n's is from about 3 to about 70 and generally from about 6 to about 35, and R is a polyvalent saturated hydrocarbyl group of up to about 10 carbon atoms having a valence of from about 3 to about 6. The alkylene groups may be straight or branched chains and contain from 1 to about 7 carbon atoms, and usually from 1 to about 4 carbon atoms. The various alkylene groups present within the above formulae may be the same or different.

More specific examples of these polyamines include:

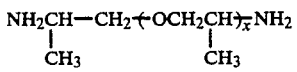

wherein x has a value of from about 3 to about 70, preferably from about 10 to 35; and

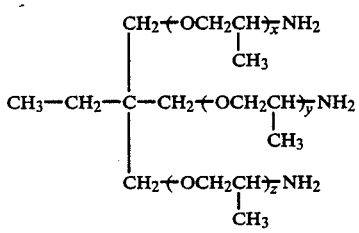

wherein x+y+z have a total value ranging from about 3 to about 30, preferably from about 5 to about 10.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine". U.S. Pat. Nos. 3,804,763 and 3,948,800 are incorporated herein by reference for their disclosure of such polyoxyalkylene polyamines.

Useful polyamines are the alkylene polyamines, including the polyalkylene polyamines, as described in more detail hereafter. The alkylene polyamines include those conforming to the formula:

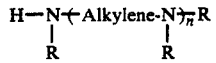

wherein n is from 1 to about 10, preferably from 1 to about 7; each R is independently a hydrogen atom, a hydrocarbyl group or a hydroxy-substituted hydrocarbyl group having up to about 700 carbon atoms, preferably up to about 100 carbon atoms, more preferably up to about 50 carbon atoms, more preferably up to about 30 carbon atoms; and the "Alkylene" group has from about 1 to about 18 carbon atoms, preferably from 1 to about 4 carbon atoms, with the preferred Alkylene being ethylene or propylene. Useful alkylene polyamines are those wherein each R is hydrogen with the ethylene polyamines, and mixtures of ethylene polyamines being particularly preferred. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines that are useful include ethylene diamine, diethylene triamine, triethylene tetramine, tetraethylene pentamine, pentaethylene hexamine, propylene diamine, trimethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene) triamine, N-(2-aminoethyl) piperazine, 1,4-bis(2-aminoethyl) piperazine, and the like. Higher homologs as are obtained by condensing two or more of the above-illustrated alkylene amines are useful as amines in this invention as are mixtures of two or more of any of the afore-described polyamines.

Ethylene polyamines, such as those mentioned above, are described in detail under the heading "Diamines and Higher Amines, Aliphatic" in The Encyclopedia of Chemical Technology, Third Edition, Kirk-Othmer, Volume 7, pp. 580–602, a Wiley-Interscience Publication, John Wiley and Sons, 1979, these pages being incorporated herein by reference. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Aliphatic alkylene polyamines containing at least one olefinic polymer chain having a number average molecular weight of from about 500 to about 10,000 attached to a nitrogen and/or to a carbon atom of an alkylene group containing and amino nitrogen atom may also be used. Preferred examples of these aliphatic alkylene polyamines have the structural formula

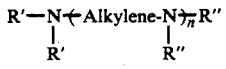

wherein R' is hydrogen or a polyolefin having a number average molecular weight in the range from about 500 to about 10,000; Alkylene is an alkylene group having from 1 to 18 carbon atoms, preferably from 1 to about 4 carbon atoms; R'' is hydrogen or lower alkyl, with the proviso that at least one of R' or R'' is hydrogen and at least one R' is a polyolefin; and n is 1 to about 10. Preferred examples include those wherein one R' is a branched chain olefin polymer in the number average molecular weight in the range of about 500 to about 5000, and the other R' is hydrogen. Preferably one R' is hydrogen and one R' is polypropylene or polyisobutylene with a number average molecular weight in the range of about 600 to about 1300.

The olefinic polymers (R') which are reacted with polyamines include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-poly-alpha-methyl styrene groups and the corresponding groups without double bonds. Particularly preferred are polypropylene and polyisobutylene groups.

The R'' group may be hydrogen but is preferably lower alkyl, e.g., containing up to 7 carbon atoms and more preferably is selected from methyl, ethyl, propyl and butyl.

The polyamines reacted with the olefinic polymers (R') include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to 18 carbon atoms. In the preparation of these compounds the same amines can be used such as: N-methyl ethylene diamine, N-propyl ethylene diamine, N,N-dimethyl 1,3-propane diamine, N-2-hydroxypropyl ethylene diamine, penta-(1-methylpropylene) hexamine, tetrabutylene-pentamine, hexa-(1,1-dimethylethylene) heptamine, di-(1-methylamylene) triamine, tetra-(1,3-dimethylpropylene) pentamine, penta-(1,5-dimethylamylene) hexamine, di(1-methyl-4-ethylbutylene) triamine, penta-(1,2-dimethyl-1-isopropylethylene) hexamine, tetraoctylenepentamine and the like.

Compounds possessing triamine as well as tetramine and pentamine groups are applicable for use because these can be prepared from technical mixtures of polyethylene polyamines, which offers economic advantages.

The polyamines reacted with the olefinic polymers (R') may also include cyclic polyamines, for example, the cyclic polyamines formed when aliphatic polyamines with nitrogen atoms separated by ethylene groups are heated in the presence of hydrogen chloride.

An example of a suitable process for the preparation of these aliphatic alkylene polyamines is the reaction of a halogenated hydrocarbon having at least one halogen atom as a substituent and a hydrocarbon chain as defined hereinbefore with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at an elevated temperature in the presence of a solvent; particularly a solvent having a boiling point of at least about 160° C.

The reaction between a polyhydrocarbon halide and a polyamine having more than one nitrogen atom available for this reaction preferably is effected in such a way that cross-linking is reduced to a minimum, for instance, by applying an excess of polyamine.

The aliphatic alkylene polyamines may also be prepared by alkylation of low molecular weight aliphatic polyamines. For example, a polyamine is reacted with an alkyl or alkenyl halide. The formation of the alkylated polyamine is accompanied by the formation of hydrogen halide, which is removed, for example, as a salt of starting polyamine present in excess. With this reaction between alkyl or alkenyl halide and the strongly basic polyamines dehalogenation of the alkyl or alkenyl halide may occur as a side reaction, so that hydrocarbons are formed as by-products.

Alkoxylated alkylene polyamines (e.g., N,N-(diethanol)-ethylene diamine) can be used. Such polyamines can be made by reacting alkylene amines (e.g., ethylenediamine) with one or more alkylene oxides (e.g., ethylene oxide, octadecene oxide) of two to about 20 carbons. Similar alkylene oxide-alkanol amine reaction products can also be used such as the products made by reacting the afore-described primary, secondary or tertiary alkanol amines with ethylene, propylene or higher epoxides in a 1:1 or 1:2 molar ratio. Reactant ratios and temperatures for carrying out such reactions are known to those skilled in the art.

Specific examples of alkoxylated alkylene polyamines include N-(2-hydroxyethyl) ethylene diamine, N,N-bis(2-hydroxyethyl)-ethylene-diamine, 1-(2-hydroxyethyl) piperazine, mono(hydroxypropyl)-substituted diethylene triamine, di(hydroxypropyl)-substituted tetraethylene pentamine, N-(3-hydroxybutyl)-tetramethylene diamine, etc. Higher homologs obtained by condensation of the above-illustrated hydroxy alkylene polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid mono- or polyamines are also useful.

Hydroxyalkyl alkylene polyamines having one or more hydroxyalkyl substituents on the nitrogen atoms, are also useful. Useful hydroxyalkyl-substituted alkylene polyamines include those in which the hydroxyalkyl group is a lower hydroxyalkyl group. Examples of such hydroxyalkyl-substituted polyamines include N-(2-hydroxyethyl) ethylene diamine, N,N-bis(2-hydroxyethyl) ethylene diamine, 1-(2-hydroxyethyl)-piperazine, monohydroxypropyl-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

Reactant (C)

The acids and acid-producing compounds (C) can be any of the acylating agents (A) discussed above, as well as any mineral acid, organic acid or acid-producing compound that is capable of forming a salt with the polyamine (B).

Examples of mineral acids that are useful include nitric acid, nitrous acid, sulfuric acid, sulfurous acid, hydrochloric acid, silicic acid, boric acid, perchloric acid, chloric acid, chlorous acid, hypochlorous acid, permanganic acid, chromic acid, dichromic acid, hydrofluoric acid, hydrobromic acid, hydriodic acid, hydrosulfuric acid, etc.

Phosphorus acids and phosphorus acid-producing compounds are also useful. The phosphorus acid-producing compounds include phosphorus acids, anhydrides, esters and halides. The phosphorus include phosphoric acids, phosphorus acids, phosphinyl acids (including phosphinic acids and phosphinous acids), and phosphonyl acids (including phosphonic acids and phosphonous acids). The phosphorus acids also include the oxyphosphorus acids, the thiophosphorus acids, as well as the mixed oxythiophosphorus acids (i.e., those containing both oxygen and sulfur). Thus, a "phosphoric acid" is used in a generic sense to denote the class consisting of phosphoric acid ($H_3PO_4$), phosphorotetrathioic acid ($H_3PS_4$), phosphoromonothioic acid ($H_3PO_3S$), phosphorodithioic acid ($H_3PO_2S_2$), and phosphorotrithioic acid ($H_3POS_3$). The acids containing both oxygen and sulfur may be further characterized according to the manner in which the oxygen or sulfur is attached to the phosphorus atom of the acid. The nomenclature used here follows essentially that proposed by the American Chemical and Engineering News, Vol. 30, No. 43, Oct. 27, 1952. According to this nomenclature, for instance, a phosphoromonothioic acid in which the sulfur atom is attached only to the phosphorus atom (i.e., —P(S)(OH)) is a phosphorothionic acid whereas its isomer in which the sulfur atom is attached to both the phosphorus atom and a hydrogen atom (i.e., —P(O)(SH)) is a phosphorothiolic acid. Also according to this nomenclature, the inclusion of thio analogs is admitted only when generic expressions are used and the specific designation of dioctylphosphoric acid refers to the oxy-acids only, i.e., $(Octyl—O)_2P(O)(OH)$. Thus, dialkylphosphoric acids, i.e., dialkyl esters of phosphoric acids, include dialkylphosphoric acid ($(Alkyl—O)_2P(O)(OH)$); dialkylphosphorotetrathioic acid ($(Alkyl—S)_2—P(S)(SH)$); O,S-dialkylphosphorodithionic acid $$((Alkyl—O)(Alkyl—S)P(S)(O)(H))$$

O,S-dialkylphosphorodithiolic acid $$((Alkyl—O)(Alkyl—S)P(O)(SH)$$

O,S-dialkylphosphorotrithioic acid $$((Alkyl—O)(Alkyl—S)P(S)(SH)$$

etc. Similarly, diarylphosphinic acids include: diarylphosphinic acid ($(Aryl_2P(O)(OH)$); diarylphosphinodithioic acid ($Aryl_2P(S)(SH)$); diarylphosphinothionic acid ($Aryl_2P(S)(OH)$); and diarylphosphinothiolic acid ($Aryl_2P(O)(SH)$).

Specific examples of the organic phosphonyl and phosphinyl acids include: diphenylphosphinic acid, dinaphthylphosphinodithioic acid, diheptylphosphinic acid, di(heptylphenyl)phosphinous acid, di(chlorodecyl)phosphinic acid, phenylphosphonic acid, phenylphosphonous acid, phenylphosphonomonothioic acid, the acid obtained by the reaction of alpha-pinene with phosphorus pentasulfide, the acid obtained by the reaction of polyisobutene having a molecular weight of 1000 with phosphorus pentasulfide, the acid obtained by the reaction of a polyisobutene having a molecular weight of 500 with phosphorus trichloride and oxygen, and bis(o,p-dichlorophenyl)phosphinomonothioic acid.

The phosphorus acids, anhydrides, esters, and halides likewise are useful. They are illustrated by phosphorus pentoxide, phosphorus pentasulfide, phosphorus heptasulfide, phosphorus sesquisulfide, and phosphorus oxysulfide. The anhydrides of organic phosphorus acids are exemplified by the anhydrides of diphenylphosphinic acid, O,O'-dioctylphosphorodithioic acid, dinaphthylphosphinodithioic acid, etc. The halides of the phosphorus acids include, for instance, phosphorus trichloride, phosphorus pentachloride, phosphorothioic trichloride, phosphorus tribromide, diphenylphosphinic chloride, di(chlorophenyl) phosphinothioic chloride, O,O'-diphenylphosphorothioic chloride, phenylphosphonic dichloride, diphenylphosphinous chloride, diphenylphosphorus trichloride, diphenylphosphinothioic bromide, etc.

The esters of the phosphorus acids may be the completely esterified acids or partially esterified acids. The latter are also known as acidic esters, i.e., at least a portion of the acid is not esterified; they are illustrated by the mono- or the di-esterified phosphoric or phosphorus acids and the mono-esterified phosphonic or phosphonous acids. The ester portion may be derived from a hydrocarbon or a substantially hydrocarbon group usually one having less than about 30 carbon atoms, preferably from about 1 to about 24 aliphatic carbon atoms. These groups are exemplified by methyl, ethyl, chloromethyl, o-chlorophenyl, p-bromophenyl, alpha-chloronaphthyl, beta-heptylnaphthyl, o,p-dimethoxyphenyl, tolyl, isobutyl, octadecyl, 4-chloro-2-heptadecyl, eicosyl, naphthyl, benzyl, chlorobenzyl, 2-phenylethyl, cyclohexyl, cyclopentyl, 2-methylcyclohexyl, the hydrocarbon group derived from polypropene having a molecular weight of about 1500, the hydrocarbon group derived from polyisobutene having a molecular weight of about 5000, behenyl, stearyl, oleyl, allyl, propargyl, o-heptylphenyl, 2,4,6-trimethylphenyl, 2-mercaptophenyl, m-nitrophenyl, methoxytetraethoxymethyl, 10-keto 1-octadecyl, polyisobutene (molecular weight of about 1000)-substituted phenyl, xenyl, 5-naphthyl-2-decyl, 10-tolyl-1-stearyl, and 9,10-dichlorostearyl group.

Useful esters include methyl ester of phosphoric acid, dimethyl ester of phosphoric acid, trimethyl ester of phosphoric acid, methyl ester of phosphorothionic acid, O-methyl ester of phosphorothiolic acid, dicyclohexyl ester of phosphoric acid, O,O'-dicyclohexyl ester of phosphorodithioic acid, dicyclohexyl ester of phosphorotetrathioic acid, O-cyclohexyl-S-decyl ester of phosphoromonothioic acid, O,O'-diphenyl ester of phosphoromonothiolic acid, triphenyl ester of phosphoric acid, triphenyl ester of phosphorus acid, tritolyl ester of phosphoric acid, dioctadecyl ester of phosphorus acid, trinaphthyl ester of phosphorus acid, trinaphthyl ester of phosphoric acid, O,O'-dinaphthyl ester of phosphoromonothionic acid, O,O'-dinaphthyl ester of phosphorothiolic acid, di(heptylphenyl) ester of phosphoric acid, bis(dichlorophenyl) ester of phosphorus acid, S-benzyl ester of phosphoromonothiolic acid, S,S'-di(phenylethyl) ester of phosphorodithioic acid, O,S-didecyl ester of phosphorotrithiolic acid, S,S'-didodecyl ester of phosphorotrithiolic acid, diphenyl ester of phosphorotetrathioic acid, O-dodecyl-S-phenyl ester of phosphoromonothiolic acid, O,O'-diisooctyl ester of phosphorodithioic acid, di(nitrophenyl) ester of phosphoric acid, O,O'-di(nitrophenyl) ester of phosphorodithioic acid, O,O'-di(methoxyphenyl) ester of phosphorodithioic acid, O,O'-di(methoxyphenyl) ester of phosphorodithioic acid, di(heptylphenyl-(O—$C_2H_4$)20)

ester of phosphoric acid, di(-methyl-(O—$C_3H_7$)-15) ester of phosphoric acid, decyl octadecyl ester of phosphoric acid, di(4-keto-1-decyl) ester of phosphoric acid, methyl ester of diphenylphosphinic acid, ethyl ester of diphenylphosphinodithioic acid, cyclohexyl ester of dinaphthylphosphinomonothiolic acid, octyl ester of dicyclohexylphosphinomonothioic acid, dimethyl ester of methylphosphonic acid, dimethyl ester of ethylphosphonomonothionic acid, dodecyl ester of cyclohexylphosphonic acid, tertiary-butyl ester of di(heptylphenyl)phosphinous acid, diphenyl ester of phenylphosphonotrithioic acid, diphenyl ester of phenylphosphonous acid, di(polyisobutene (number average molecular weight of about 1500)-substituted phenyl) ester of phosphoric acid, O,O'-di-(polypropene (number average molecular weight of about 300)-substituted naphthyl) ester of phosphorodithioic acid, and oleyl ester of phosphoric acid.

The esters of phosphoric acid and phosphorothioic acids are obtained by the reaction of phenol or an alcohol with phosphoric acid or a phosphorothioic acid, or an anhydride of the acid such as phosphorus pentoxide, phosphorus pentasulfide, or phosphorus oxysulfide. The reaction is usually carried out simply by mixing the reactants at a temperature above about 50° C., preferably between about 80° C. and 150° C. In many instances, however, the esters of phosphoric acids tend to decompose at high temperatures. Thus it is often desirable to avoid prolonged exposure of the reaction mixture to temperatures above about 150° C. A solvent may be used in the reaction to facilitate mixing of the reactants and control of the reaction temperature. The solvent may be benzene, naphtha, chlorobenzene, mineral oil, kerosene, cyclohexane, or carbon tetrachloride. A solvent capable of forming a relatively low boiling azeotrope with water further aids the removal of water in the esterification of an alcohol or phenol with the phosphorus acid reactant. The relative amounts of the alcohol or phenol reactant and the acid reactant influence the nature of the ester obtained. For instance, equimolar amounts of an alcohol and phosphoric acid tend to result in the formation of a monoester of phosphoric acid whereas the use of a molar excess of the alcohol reactant in the reaction mixture tends to increase the proportion of the diester or triester in the product. In most instances the product will be a mixture of the mono-, di-, and triesters of the acid.

The reaction of an alcohol or phenol with phosphorus pentasulfide ordinarily results in O,O'-diester of phosphorodithioic acid. Such a reaction involves four moles of the alcohol or phenol per mole of phosphorus pentasulfide and may be carried out within the temperature range from about 50° C. to about 250° C. Thus, the preparation of O,O'-di-n hexylphosphorodithioic acid involves the reaction of phosphorus pentasulfide with four moles of n-hexyl alcohol at about 100° C. for about 2 hours. Hydrogen sulfide is liberated and the residue is the defined acid. Treatment of the phosphorodithioic acid with water or steam removes one or both sulfur atoms and converts the product to the corresponding phosphoromonothioic acid or phosphoric acid.

The esters of phosphorotetrathioic acid can be prepared by first the reaction of a mercaptan or thiophenol with $PSCl_3$ or $PSBr_3$ to produce an intermediate which is either a phosphorotrithioic halide or triester of phosphorotetrathioic acid and the subsequent reaction of the intermediate with hydrogen sulfide or sodium hydrosulfide. The esters of phosphorotrithioic acids are obtained by the treatment of the esters of the phosphorotetrathioic acids with water or steam.

The esters of phosphorus acids are obtained by the reaction of an alcohol or phenol with phosphorus acid or a phosphorus trihalide such as phosphorus tribromide or phosphorus trichloride and the above noted reaction usually requires carefully controlled conditions such as low temperature in order to give a substantial yield of the esters of phosphorus acids. Under other conditions the reaction of an alcohol or phenol with a phosphorus trihalide may result in a phosphonic acid or ester. Such esters are readily susceptible to rearrangement to phosphonic acids and esters.

The esters of phosphinic, phosphinous, phosphonic, and phosphonous acids are obtained by either direct esterification of the acid or an anhydride with an alcohol or phenol or the reaction of an acid halide with an alcohol or phenol. They are also obtained by the reaction of a salt of the acid such as sodium or ammonium salt of the acid with a suitable halogenated hydrocarbon. The methods for preparing the phosphorus acids and their anhydrides, esters, and halides are known in the art and are not discussed in further detail here.

Sulfonic acids and acid-producing compounds are also useful. The sulfonic acids may be represented by the formulae $R^1(SO_3H)_r$ or $(R^2)_xT(SO_3H)y$. In these formulae, $R^1$ is a hydrocarbyl group, preferably an aliphatic or aliphatic-substituted cycloaliphatic hydrocarbyl group containing up to about 60 carbon atoms. When $R^1$ is aliphatic, it usually contains at least about 15 carbon atoms; when it is an aliphatic-substituted cycloaliphatic group, the aliphatic substituents usually contain a total of at least about 12 carbon atoms. Examples of $R^1$ include alkyl, alkenyl and alkoxyalkyl groups, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ include cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing from about 1 to about 8 carbon atoms per olefinic monomer unit. $R^1$ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially aliphatic character thereof is not destroyed.

$R^2$ is preferably a hydrocarbyl group containing from about 4 to about 60 carbon atoms. $R^2$ is preferably an aliphatic hydrocarbyl group such as alkyl or alkenyl. It may also, however, contain substituents or interrupting groups such as those enumerated above provided the essentially hydrocarbon character thereof is retained. In general, the noncarbon atoms present in $R^1$ or $R^2$ do not account for more thabn 10% of the total weight thereof.

The group T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally from 1 to about 3. The subscripts r and y have an average value of about 1 to about 4 per molecule and are generally also 1.

Illustrative sulfonic acids include mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, di-lauryl beta-naphthol sulfonic acids, dicapryl nitro-naphthalene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetyl-cyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well known and require no further discussion herein.

Sulfonic acid-producing compounds include their metal salts, such as the alkaline earth, zinc and lead salts; ammonium salts and amine salts (e.g., the ethylamine, butylamine and ethylene polyamine salts); and esters such as the ethyl, butyl, and glycerol esters.

Formation of the Nitrogen-Containing Emulsifiers

The nitrogen-containing emulsifiers are preferably prepared by initially reacting the acylating agent (A) with the polyamine (B) to form a nitrogen-containing intermediate, and thereafter reacting said nitrogen-containing intermediate with the acid or acid-producing compound (C). An alternative method of preparing these emulsifiers involves preparing a mixture of the acylating agent (A) and acid (C), and reacting the mixture with the polyamine (B). Another alternative method involves initially reacting the polyamine (B) with the acid (C), and thereafter with the acylating agent (A).

The ratio of reactants utilized in the preparation of the nitrogen-containing emulsifiers may be varied over a wide range. Generally, the reaction mixture will contain, for each equivalent of the acylating agent (A), at least about 0.5 equivalent of the polyamine (B), and from about 0.1 to about 1 equivalent or more of the acid (C) per equivalent of the polyamine (B). The upper limit of the polyamine (B) is about 2 equivalents per equivalent of the acylating agent (A). Preferred amounts of the reactants are from about 1 to about 2 equivalents of the polyamine (B) and from about 0.1 to about 2 equivalents of the acid (C) for each equivalent of the acylating agent (A).

The number of equivalents of the acylating agent (A) depends on the total number of carboxylic functions present. In determining the number of equivalents of the acylating agent (A), those carboxyl functions which are not capable of reacting as a carboxylic acid acylating agent are excluded. In general, however, there is one equivalent of acylating agent (A) for each carboxy group in the acylating agent. For example, there would be two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of acylating agent (A) can be readily determined by one skilled in the art.

An equivalent of a polyamine (B) is the molecular weight of the polyamine divided by the total number of nitrogens present in the molecule. Thus, octylamine has an equivalent weight equal to its molecular weight; ethylene diamine has an equivalent weight equal to one-half of its molecular weight. The equivalent weight of a commercially available mixture of polyalkylene polyamine can be determined by dividing the atomic weight of nitrogen (14) by the % N contained in the polyamine; thus, a polyamine mixture having a % N of 34 would have an equivalent weight of 41.2.

When the acid (C) is one of the acylating agents (A), an equivalent thereof is the same as discussed above with respect to such acylating agents (A). When the acid (C) is a mineral acid, an equivalent thereof is equal to its molecular weight. An equivalent of a phosphorus acid or phosphorus acid-producing compound is its molecular weight divided by the number of phosphorus acid groups or phosphorus acid derivative groups present therein. An equivalent of a sulfonic acid or sulfonic acid-producing compound is its molecular weight divided by the number of sulfonic acid groups or sulfonic acid derivative groups present therein. Thus, for a monosulfonic acid the equivalent weight is equal to the molecular weight.

The temperature of the reaction used to prepare the nitrogen-containing emulsifiers of this invention is not critical, and generally, any temperature from about 20° C. up to the decomposition temperature of the reactant or product having the lowest such temperature can be utilized. Preferably, however, the temperature will be above about 50° C. and more generally from about 100° C. to about 250° C.

When it is desired to prepare an initial nitrogen-containing intermediate by reaction of the acylating agent (A) and the polyamine (B), a mixture of one or more of the acylating agents and one or more of the polyamines is heated, optionally, in the presence of a normally liquid, substantially inert organic liquid solvent/diluent. The reaction temperature will be, as defined above, generally above about 50° C up to the decomposition temperature of any of the reactants or of the product. The reaction of the acylating agent (A) with the polyamine (B) is accompanied by the formation of approximately one mole of water for each equivalent of the acid used. The removal of water formed may be effected conveniently by heating the product at a temperature above about 100° C., preferably at about 150° C. Removal of the water may be facilitated by blowing the reaction mixture with an inert gas such as nitrogen during heating It may likewise be facilitated by the use of a solvent which forms an azeotrope with water. Such solvents are exemplified by benzene, toluene, naphtha, n-hexane, xylene, etc. The use of such solvents permits the removal of water at a lower temperature, e.g., 80° C.

The reaction of the acylating agent (A) with the polyamine (B) to form the initial nitrogen-containing intermediate is conducted by methods well known in the art for preparing acylated amines. It is not believed necessary to unduly lengthen this specification by a further discussion of the reaction. Accordingly, U.S. Pat. Nos. 3,172,892; 3,219,666; 3,272,746; and 4,234,435 are expressly incorporated herein by reference for their disclosure with respect to the procedures applicable for reacting acylating agents with polyamines.

The product of the reaction between components (A), (B) and (C) preferably contains at least some salt to permit said product to be effective as an emulsifier in accordance with the invention. Preferably from about 10% to about 100%, more preferably from about 30% to about 100%, more preferably from about 50% to about 100%, more preferably from about 70% to about 100% of the nitrogen atoms in the polyamine (B) that have not reacted with the acylating agent (A) are reacted to form a salt linkage with the acid or acid-producing compound (C).

The following Examples 1–18 illustrate the initial preparation of the nitrogen-containing intermediates useful in this invention. These intermediate compositions also can be referred to as "acylated amines". Unless otherwise indicated in the following examples and elsewhere in the specification and claims, all parts and percentages are by weight, and temperatures are in degrees centigrade.

EXAMPLE 1

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7%.

EXAMPLE 2

To 1133 parts of commercial diethylene triamine heated at 110°–150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blown with nitrogen to remove volatiles. The mixture is held at 205°–230° C. for a total of 11.5 hours and then stripped at 230° C./20 torr to provide the desired acylated polyamine as a residue containing 6.2% nitrogen.

EXAMPLE 3

To 205 parts of commercial tetraethylene pentamine heated to about 75° C. there is added 1000 parts of isostearic acid while purging with nitrogen, and the temperature of the mixture is maintained at about 75°–110° C. The mixture then is heated to 220° C. and held at this temperature until the acid number of the mixture is less than 10. After cooling to about 150° C., the mixture is filtered, and the filtrate is the desired acylated polyamine having a nitrogen content of about 5.9%.

EXAMPLE 4

A mixture of 510 parts (0.28 mole) of polyisobutene (Mn=1845; Mw=5325) and 59 parts (0.59 mole) of maleic anhydride is heated to 110° C. This mixture is heated to 190° C. in seven hours during which 43 parts (0.6 mole) of gaseous chlorine is added beneath the surface. At 190°–192° C., an additional 11 parts (0.16 mole) of chlorine is added over 3.5 hours. The reaction mixture is stripped by heating at 190°–193° C. with nitrogen blowing for 10 hours. The residue is the desired polyisobutene-substituted succinic acylating agent having a saponification equivalent number of 87 as determined by ASTM procedure D-94.

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the above substituted succinic acylating agent at 138° C. The reaction mixture is heated to 150° C. in two hours and stripped by blowing with nitrogen. The reaction mixture is filtered to yield the filtrate as an oil solution of the desired product.

EXAMPLE 5

An acylated nitrogen intermediate is obtained by mixing at 150° C., 242 parts (by weight) (5.9 equivalents) of a commercial polyethylene polyamine mixture having a nitrogen content of 34.2% and 1600 parts (2.9 equivalents) of a polyisobutene-substituted succinic anhydride having an acid number of 100 and prepared by the reaction of a chlorinated polyisobutene having a chlorine content of approximately 4.5% and a molecular weight of 1000 with 1.2 moles of maleic anhydride at 200° C. The product is diluted with mineral oil to form a 60% oil solution having a nitrogen content of 2.64%.

EXAMPLE 6

A mixture of 248 parts (by weight) of mineral oil, 37 parts of a commercial polyethylene polyamine mixture having a nitrogen content of 34% and 336 parts of the polyisobutene-substituted succinic anhydride of Example 1 is heated at 150° C. for one hour and blown with L nitrogen at 150°–155° C. for 5 hours. The product is filtered and the filtrate has a nitrogen content of 2.06%.

EXAMPLE 7

A polyisobutenyl succinic anhydride is prepared by the reaction of a chlorinated polyisobutylene with maleic anhydride at 200° C. The polyisobutenyl group has a number average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction causes the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE 8

The procedure of Example 7 is repeated except that the diethylene triamine is replaced on a nitrogen equivalent basis with ethylene diamine.

EXAMPLE 9

A substituted succinic anhydride is prepared by reacting maleic anhydride with a chlorinated copolymer of isobutylene and styrene. The copolymer consists of 94 parts by weight of isobutylene units and 6 parts by weight of styrene units, has an average molecular weight of 1200, and is chlorinated to a chlorine content of 2.8% by weight. The resulting substituted succinic anhydride has an acid number of 40. To 710 grams (0.15 equivalent) of this substituted succinic anhydride and 500 grams of toluene there is added portionwise 22 grams (0.51 equivalent) of hexaethylene heptamine. The mixture is heated at reflux temperature for three hours to remove by azeotropic distillation all of the water formed in the reaction, and then at 150° C./20 mm to remove the toluene.

EXAMPLE 10

A polyisobutylene having an average molecular weight of 50,000 is chlorinated to a chlorine content of 10% by weight. This chlorinated polyisobutylene is reacted with maleic anhydride to produce the corresponding polyisobutenyl succinic anhydride having an acid number of 24. To 6000 grams (2.55 equivalents) of this anhydride there is added portionwise at 70°-105° C., 108 grams (2.55 equivalents) of triethylene tetramine over a period of 45 minutes. The resulting mixture is heated for four hours at 160°-180° C. while nitrogen is bubbled throughout to remove the water. When all of the water has been removed, the product is filtered.

EXAMPLE 11

A polyisobutenyl-substituted succinic anhydride is prepared by the reaction of a chlorinated polyisobutene having a chlorine content of about 4.7% and a molecular weight of 1000 with about 1.2 moles of maleic anhydride. A mixture of 1647 parts (1.49 moles) of this polyisobutenyl substituted succinic anhydride and 1221 parts of mineral oil is prepared and heated to 75° C. with stirring whereupon 209 parts (2 moles) of aminoethylethanolamine are added with stirring. The mixture is blown with nitrogen and heated to about 180° C. The reaction mixture is maintained at this temperature with nitrogen blowing, and the water formed in the reaction is removed. The residue in the reaction vessel is the desired nitrogen-containing composition.

EXAMPLE 12

The procedure of Example 1 is repeated except that the polyisobutene-substituted succinic anhydride is first converted to the corresponding succinic acid by treatment with steam at 150° C. and the succinic acid so produced is used in place of the anhydride in the reaction with the polyamine.

EXAMPLE 13

The procedure of Example 6 is repeated except that the polyisobutene-substituted succinic anhydride is replaced on a chemical basis with the corresponding dimethyl ester of the anhydride prepared by esterifying the anhydride with two moles of the methyl alcohol.

EXAMPLE 14

The procedure of Example 6 is repeated except that the polyisobutene-substituted succinic anhydride is replaced on a chemical basis with the corresponding succinic dichloride prepared by hydrolyzing the anhydride with steam at 120° C. to form the corresponding acid and then treating the acid with phosphorus pentachloride.

EXAMPLE 15

A mixture of 3663 parts (3.3 moles) of a polyisobutenyl succinic anhydride prepared as in Example 11 and 2442 parts of a diluent oil is prepared, stirred and heated to a temperature of 110° C. Aminoethylethanolamine (343 parts, 3.3 moles) is added over a period of 0.25 hour and the reaction temperature reaches 125° C. The mixture then is heated with nitrogen blowing to a temperature of about 205° C. over a period of 2 hours while removing water. The residue is the desired product containing 1.44% nitrogen.

EXAMPLE 16

A mixture of 4440 parts of the polyisobutenyl succinic anhydride prepared as in Example 11 and 1903 parts of kerosene is prepared and heated to a temperature of 120° C. whereupon 416 parts (4 moles) of aminoethylethanolamine are added over a period of 0.4 hour. The mixture is then heated to about 200° C. in 1 hour under nitrogen and maintained at a temperature of about 200°-205° C. while removing water and some kerosene. The residue is the desired nitrogen-containing composition containing 1.68% nitrogen.

EXAMPLE 17

A reaction mixture comprising 196 parts by weight of mineral oil, 280 parts by weight of a polyisobutenyl (M.W. 1000)-substituted succinic anhydride (0.5 equivalent) and 30.8 parts of a commercial mixture of ethylene polyamine having an average composition corresponding to that of tetraethylene pentamine (0.75 equivalent) is mixed over a period of approximately 15 minutes. The reaction mass is then heated to 150° C. over a 5-hour period and subsequently blown with nitrogen at a rate of 5 parts per hour for 5 hours while maintaining a temperature of 150°-155° C. to remove water. The material is then filtered to produce the desired product.

EXAMPLE 18

The procedure of Example 17 is repeated except that the ratio of equivalents of anhydride to amine is 1:2.

The following Examples I-XXXIV illustrate the preparation of the nitrogen-containing emulsifiers used in the explosive compositions of the invention.

EXAMPLE I

A mixture of 140 parts of a mineral oil, 174 parts of a polyisobutene (number average molecular weight 1000)-substituted succinic anhydride having an acid number of 105 and 23 parts of stearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. for one hour, cooled to 110° C. and filtered. The filtrate is found to contain 1.7% nitrogen and has an acid number of 4.5.

EXAMPLE II

A mixture of 528 grams (1 equivalent) of the polyisobutene-substituted succinic anhydride of Example I, 295 grams (1 equivalent) of a fatty acid derived from distillation of tall oil and having an acid number of 190, 200 grams of toluene and 85 grams (2 equivalents) of the polyalkylene polyamine mixture of Example I is heated at the reflux temperature while water is removed by azeotropic distillation. The toluene is removed by distillation and the mixture heated at 180°-190° C. for 2 hours, then to 150° C./20 mm. The residue is found to have a nitrogen content of 3.3% and an acid number of 9.8.

EXAMPLE III

A mixture of 33.2 grams (0.93 equivalent) of diethylene triamine, 100 grams (2.77 equivalents) of triethylene tetramine, 1000 grams (1.85 equivalents) of the polyisobutene substituted succinic anhydride of Example I and 500 grams of mineral oil is prepared at 100°-109° C. and heated at 160° 170° C. for one hour. The mixture is cooled and mixed with 266 grams (1.85 equivalents) of 2-ethyl hexanoic acid at 75°-80° C., and the resulting mixture is heated at 160°-165° C. for 12 hours. A total of 64 grams of water is removed as distillate. The residue is diluted with 390 grams of mineral oil, heated to 160° C. and filtered. The filtrate is found to have a nitrogen content of 2.3%.

EXAMPLE IV

To a mixture of 528 grams (1 equivalent) of the polyisobutene-substituted succinic anhydride of Example I, 30 grams (0.5 equivalent) of glacial acetic acid in 402 grams of mineral oil there is added 64 grams (1.5 equivalents) of the polyalkylene polyamine mixture of Example I at 70°-85° C. in one-quarter hour. The mixture is purged with nitrogen at 210°-220° C. for 3 hours and then heated to 210° C./50 mm. The residue is cooled and filtered at 70°-90° C. The filtrate is found to have a nitrogen content of 2% and an acid number of 2.

EXAMPLE V

A mixture of 1160 parts of the oil solution of Example 4, and 73 parts of terephthalic acid is heated at 150°-160° C. for about 4 hours and filtered. The filtrate is the desired product.

EXAMPLE VI

A mixture of 2852 parts of the product of Example 5 and 199 parts (2.7 equivalents) of phthalic anhydride is heated at 150°-160° C. for 4 hours whereupon water is removed by distillation.

EXAMPLE VII

A mixture of the product of Example 6 and 9.3 parts of terephthalic acid is heated at 155° C. for 0.5 hour and filtered. The filtrate is the desired product having a nitrogen content of 2.03%.

EXAMPLE VIII

A mixture of the product of Example 7 and 0.1 equivalent (per equivalent of nitrogen in the product of 7) of 2-methyl benzene-1,3-dicarboxylic acid is heated at 135° C. for 3 hours while removing water.

EXAMPLE IX

A mixture of 2934 grams (5.55 equivalents based on the amine content) of the oil solution of the acylated nitrogen intermediate of Example 1 and 230 grams (2.77 equivalents) of terephthalic acid is heated at 150°-160° C. until all of the water formed by the reaction is removed by distillation. The residue is heated at 160° C. and 5-6 mm. Hg. and mixed with 141 grams of mineral oil and filtered. The filtrate is a 60% oil solution of the desired product having a nitrogen content of 2.47%.

EXAMPLE X

An acylated nitrogen intermediate is prepared as is described in Example 1 except that the amount of the amine reactant used is 1.5 equivalents per equivalent of the anhydride reactant. A mixture of 738 grams (1.05 equivalents based on the amine present in the intermediate) of the intermediate and 11.2 grams (0.13 equivalent) of terephthalic acid is heated at 140°-150° C. for 2 hours and then filtered. The filtrate has a nitrogen content of 1.9%.

EXAMPLE XI

The procedure of Example X is repeated except that 5.6 grams (0.064 equivalent) of terephthalic acid is used in the reaction mixture. The product so obtained has a nitrogen content of 2%.

EXAMPLE XII

The procedure of Example X is repeated except that 1,6-naphthalene dicarboxylic acid (7.5 grams, 0.09 equivalent) is used in place of terephthalic acid and the amount of the acylated nitrogen intermediate used is 492 (0.725 equivalents). The product so obtained has a nitrogen content of 1.9%.

EXAMPLE XIII

An acylated nitrogen intermediate is prepared by the procedure of Example 1 from 1.4 equivalents of the commercial polyethylene polyamine and 1 equivalent of the polyisobutene-substituted succinic anhydride. To 2000 grams of a 60% oil solution of the intermediate, there is added 74 grams of phthalic anhydride at room temperature. A slight exothermic reaction occurs. The reaction mixture is heated at 200°-210° C. for 10 hours whereupon water is distilled off. The residue is filtered and the filtrate has a nitrogen content of 1.84%.

EXAMPLE XIV

A mixture of 526 grams (1 equivalent) of the polyisobutene-substituted succinic anhydride of Example 1, 73 grams (1 equivalent) of phthalic anhydride and 300 grams of xylene is prepared at 60° C. To this mixture there is added at 60°-90° C., 84 grams (2 equivalents) of a commercial polyethylene polyamine mixture having a nitrogen content of 73.4% and an equivalent weight of 42. The mixture is heated at 140°-150° C. whereupon 18 grams of water is distilled off. The residue is mixed with 455 grams of mineral oil and heated to 150° C. and 20 mm. Hg. to distill off all volatile components and then is filtered. The filtrate is a 60% oil solution of the product having a nitrogen content of 2.35%.

EXAMPLE XV

The procedure of Example XIV is repeated except that the reaction mixture consists of 790 grams (1.5 equivalent) of the polyisobutene-substituted succinic anhydride, 36.5 grams (0.5 equivalent) of phthalic anhydride and 84 grams (2 equivalents) of the polyethylene polyamine. The product, a 60% oil solution of the nitrogen composition, has a nitrogen content of 1.27%.

EXAMPLE XVI

The procedure of Example VI is repeated except that the polyisobutene-substituted succinic anhydride is first converted to the corresponding succinic acid by treatment with steam at 150° C. and the succinic acid so produced is used in place of the anhydride in the reaction with the polyamine and phthalic anhydride.

EXAMPLE XVII

A substituted dimethylsuccinate is prepared by reacting one mole of a chlorinated petroleum oil having a molecular weight of 1200 and a chlorine content of 3% with 1.5 moles of dimethylmaleate at 250° C. A mixture of 2 equivalents of the above succinate, 10 equivalents tetrapropylene pentamine, and 1 equivalent of terephthalic acid is prepared at 25° C. and heated at 150°-180° C. for 6 hours whereupon all volatile components are distilled off and then filtered. The filtrate is the desired product.

EXAMPLE XVIII

N-octadecylpropylene diamine (1 equivalent) is heated with 0.5 equivalent of terephthalic acid at 100° C. for 1 hour. The above intermediate product is then heated at 150°-190° C. with 2 equivalents of a substituted succinic acid obtained by reacting at 120°-200° C. one mole of a chlorinated polypropylene having a molecular weight of 2500 and a chlorine content of 2.3% with 2 moles of maleic acid to form the desired product.

EXAMPLE XIX

The procedure of Example XVIII is repeated except that the substituted succinic acid is replaced on a chemical equivalent basis with the corresponding succinic acid monochloride.

EXAMPLE XX

To the product obtained in Example 11, there is added 124.5 parts of isophthalic acid in portions. The mixture is heated to 200° C. and maintained at this temperature until no more water can be removed. The mixture is filtered to give the desired product containing 1.7% nitrogen.

EXAMPLE XXI

The procedure of Example XX is repeated except that the isophthalic acid is replaced by an equivalent amount of phthalic anhydride.

EXAMPLE XXII

The procedure of Example XX is repeated except that the isophthalic acid is replaced by an equivalent amount of isostearic acid.

EXAMPLE XXIII

The procedure of Example XX is repeated except that the isophthalic acid is replaced by an equivalent amount of tetrapropenyl-substituted succinic acid.

EXAMPLE XXIV

The procedure of Example IX is repeated except that the substituted succinic anhydride is replaced by an equivalent amount of the acid prepared by reacting chlorinated polyisobutylene and acrylic acid in 1:1 equivalent ratio and having an average molecular weight of about 980.

EXAMPLE XXV

Adipic acid (36.5 parts, 0.25 mole) is added to parts (0.5 mole) of the acylated amine prepared in Example 15 and the mixture is maintained at a temperature of about 120° C. The mixture then is heated under nitrogen to a temperature of about 200° C. in 0.5 hour and maintained at about 200°-210° C. under nitrogen for an additional 2 hours while collecting water. The reaction mixture is filtered and the filtrate is the desired product containing 1.41% nitrogen.

EXAMPLE XXVI

Terephthalic acid (62.2 parts, 0.375 mole) is added to 1448 parts (0.75 mole) of the oil solution of the acylated amine prepared in Example 15. The mixture is heated to a temperature of about 225° C. over a period of about 3 hours while collecting water. The temperature then is raised to 235° C. in one hour and maintained at 235°-240° C. for about 3 hours while collecting additional water. After cooling to about 210° C., a filtrate is added with stirring and the mixture is filtered. The filtrate is the desired product containing 1.41% nitrogen.

EXAMPLE XXVII

Phthalic anhydride (74 parts, 0.5 mole) is added to 1930 parts (1 mole) of the acylated amine prepared in Example 15 at a temperature of 120° C. The mixture then is heated to 200° C. under nitrogen and maintained at a temperature of about 205°-210° C. for about 2 hours while removing water. The mixture is filtered and the filtrate is the desired product containing 1.45% nitrogen.

EXAMPLE XXVIII

The procedure of Example XXVII is repeated except that the phthalic anhydride is replaced by 83 parts (0.5 mole) of isophthalic acid. The product obtained in this manner contains 1.41% nitrogen.

EXAMPLE XXIX

To 1661 parts (1 mole) of the acylated amine prepared as in Example 15 at a temperature of 120° C. there is added 83 parts (0.5 mole) of isophthalic acid. The mixture is heated under nitrogen to a temperature of about 200°-210° C. and maintained at this temperature for about 1 hour while collecting water. The mixture is filtered and the filtrate is the desired product containing 1.62% nitrogen.

EXAMPLE XXX 1654 grams (1.30 equivalents) of the product of Example 17 are heated to a temperature of 107° C. with stirring. 361 grams (1.236 equivalents) of Unitol DSR-90 (a product of Union Camp Corporation identified as a tall oil acid) are added over a 30-minute period. The mixture is heated at a temperature of 104°-110° C. for 3-3.5 hours to provide the desired product.

EXAMPLE XXXI 1272.1 grams (1.0 equivalent) of the product of Example 17 are heated to a temperature of 106° C. with stirring. 196.8 grams (0.7 equivalent) of Unitol DSR-90 are added over a 15-minute period. The mixture is heated at a temperature of 102°-110° C. for 1.5 hours to provide the desired product.

EXAMPLE XXXII 2000 grams (1.572 equivalents) of the product of Example 17 are heated to a temperature of 100° C. with stirring. 73.36 grams (1.572 equivalents) of orthophosphoric acid are added over a 35-40 minute period. The temperature of the mixture increases to 113° C. as a result of an exotherm. The mixture is heated at a temperature of 100°-113° C. for one hour to provide the desired product.

EXAMPLE XXXIII 1602.8 grams (2.0 equivalents) of the product of Example 18 are heated to a temperature of 104° C. with stirring. 393.6 grams (1.4 equivalents) of Unitol DSR-90 are added over a 45-minute period. The mixture is heated at a temperature of 100°-109° C. for 1.5 hours. 76.0 grams of diluent oil are added to provide the desired product.

EXAMPLE XXXIV

A mixture of 691.90 grams (1.258 equivalents) of a polyisobutenyl (M.W. 950)-substituted succinic anhydride and 647.60 grams of diluent oil is heated to 81° C. with stirring. 131.50 grams (3.145 equivalents) of a commercial mixture of ethylene polyamine having an average composition corresponding to that of tetraethylene pentamine and a nitrogen content of 33.4% is added over a 5-minute period. The mixture is blown with nitrogen at a rate of 1.0 standard cubic feet per hour. The mixture is heated to and maintained at a temperature of 189°-191° C. for 4 hours. The mixture is cooled to 57° C., and 399.75 grams (1.369 equivalents) of Unitol DSR-90 are added. The mixture is maintained at 55°-62° C. for 1.25 hours to provide the desired product.

The Water-Immiscible Organic Liquid

The water-immiscible organic liquid that is useful in the explosive compositions of the invention can be a hydrocarbon oil having viscosity values from about 20 SUS (Saybolt Universal Seconds) at 40° C. to about 2500 SUS at 40° C. Mineral oils having lubricating viscosities (e.g., SAE 5-90 grade) can be used. Oils from a variety of sources, including natural and synthetic oils and mixtures thereof can be used.

Natural oils include animal oils and vegetable oils (e.g., castor oil, lard oil) as well as solvent-refined or acid-refined mineral lubricating oils of the paraffinic, naphthenic, or mixed paraffin-naphthenic types. Oils derived from coal or shale are also useful. Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); and the like.

Another suitable class of synthetic oils that can be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethyl-hexanoic acid, and the like.

Esters useful as synthetic oils also include those made from $C_5$ to $C_{12}$ monocarboxylic acids and polyols and polyol ethers such as neopentyl glycol, triamethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of useful oils. These include tetraethyl-silicate, tetraisopropylsilicate, tetra-(2-ethylhexyl)-silicate, tetra-(4-methyl-hexyl)-silicate, tetra(p-tert-butylphenyl)silicate, hexyl-(4-methyl-2-pentoxy)-di-siloxane, poly(methyl)-siloxanes, poly-(methylphenyl)-siloxanes, etc. Other useful synthetic oils include liquid esters of phosphorus-containing acid (e.g., tricresyl phosphate, trioctyl phosphate, diethyl ester of decane phosphonic acid, etc.), polymeric tetrahydrofurans, and the like.

Unrefined, refined and rerefined oils (and mixtures of each with each other) of the type disclosed hereinabove can be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed toward removal of spent additives and oil breakdown products.

Oxygen-Supplying Component

The oxygen supplying component is preferably an oxygen-supplying salt such as the ammonium, alkali or alkaline earth metal nitrates, chlorates, perchlorates and mixtures thereof. Examples include ammonium nitrate, sodium nitrate, calcium nitrate, ammonium chlorate, sodium perchlorate and ammonium perchlorate. Ammonium nitrate is especially preferred. Mixtures of ammonium nitrate and sodium or calcium nitrate are also preferred.

Emulsion Stabilizer

The emulsions of the invention can contain an effective amount of at least one emulsion stabilizer to stabilize the emulsion. Many such emulsion stabilizers are known in the art. Useful emulsion stabilizers include the esters formed by the reaction of at least one substantially saturated hydrocarbyl-substituted succinic acid having at least about 50 aliphatic carbon atoms in the substituent and a polyhydric alcohol. These esters are disclosed in U.S. Pat. No. 3,255,108, which is incorporated herein by reference.

Another class of emulsion stabilizers are the phosphatides, especially those having the structural formula

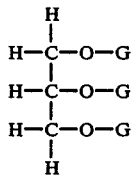

wherein G is selected from the class consisting of fatty acyl groups and phosphorus-containing groups having the structural grouping

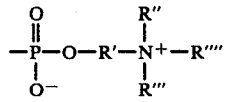

wherein R′ is a lower alkylene group having from 1 to about 10 carbon atoms, and R′, R‴ and R⁗ are lower alkyl groups having from 1 to about 4 carbon atoms, and at least one but no more than two of the G groups being said phosphorus-containing group. The fatty acyl groups are for the most part those derived from fatty acids having from about 8 to about 30 carbon atoms in the fatty groups such as octanoic acid, stearic acid, oleic acid, palmitic acid, behenic acid, myristic acid, and oleostearic acid. Especially desirable groups are those derived from commercial fatty compounds such as soyabean oil, cotton seed oil, and castor oil. A useful phosphatide is soybean lecithin which is described in detail in Encyclopedia of Chemical Technology, Kirk and Othmer, Volume 14, pages 250–269 (1981), which is incorporated herein by reference.

The emulsion stabilizer may be an aliphatic glycol or a mono-aryl ether of an aliphatic glycol. The aliphatic glycol may be a polyalkylene glycol. It is preferably one in which the alkylene group is a lower alkylene group having from 1 to about 10 carbon atoms. Thus, the aliphatic glycol is illustrated by ethylene glycol, trimethylene glycol, propylene glycol, tetramethylene glycol, 1,2-butylene glycol, 2,3-butylene glycol, tetramethylene glycol, hexamethylene glycol, or the like. Specific examples of the ethers include monophenyl ether of ethylene glycol, mono-(heptylphenyl) ether of triethylene glycol, mono-(alpha-octyl-betanaphthyl) ether of tetrapropylene glycol, mono-(polyisobutene (molecular weight of 1000)-substituted phenyl) ether of octapropylene glycol, and mono-(o,p-dibutylphenyl) ether of polybutylene glycol, mono-(heptylphenyl) ether of trimethylene glycol and mono-(3,5-dioctylphenyl) ether of tetra-trimethylene glycol, etc. The mono-aryl ethers are obtained by the condensation of a phenolic compound such as an alkylated phenol or naphthol with one or more moles of an epoxide such as ethylene oxide, propylene oxide, trimethylene oxide, or 2,3-hexalene oxide. The condensation is promoted by a basic catalyst such as an alkali or alkaline earth metal hydroxide, alcoholate, or phenate. The temperature at which the condensation is carried out may be varied within wide ranges such as from room temperature to about 250° C. Ordinarily it is preferably 50°–150° C. More than one mole of the epoxide may condense with the phenolic compound so that the product may contain in its molecular structure one or more of the groups derived from the epoxide. A polar-substituted alkylene oxide such as epichlorohydrin or epibromohydrin likewise is useful to prepare the mono-aryl ether product and such product likewise is useful as the emulsion stabilizer in this invention.

Also useful as emulsion stabilizers are the mono-alkyl ethers of the aliphatic glycols in which the alkyl group is, e.g., octyl, nonyl, dodecyl, behenyl, etc. The fatty acid esters of the mono-aryl or monoalkyl ethers of aliphatic glycols also are useful. The fatty acids include, e.g., acetic acid, formic acid, butanoic acid, hexanoic acid, oleic acid, stearic acid, behenic acid, decanoic acid, iso-stearic acid, linoleic acid, as well as commercial acid mixtures such as are obtained by the hydrolysis of tall oils, sperm oils, etc. Specific examples are the oleate of mono-(heptylphenyl)ether of tetraethylene glycol and the acetate of mono-(polypropene(having molecular weight of 1000)-substituted phenyl) ether of tri-propylene glycol.

Alkali metal and ammonium salts of sulfonic acids likewise are also useful emulsion stabilizers. The acids are illustrated by decylbenzene sulfonic acid, di-dodecylbenzene sulfonic acid, mahogany sulfonic acid, heptylbenzene sulfonic acid, polyisobutene sulfonic acid (molecular weight of 750), and decylnaphthalene sulfonic acid, and tri-decylbenzene sulfonic acid. The salts are illustrated by the sodium, potassium, or ammonium salts of the above acids.

Also useful as emulsion stabilizers are the neutral alkali metal salts of fatty acids having at least 12 aliphatic carbon atoms in the fatty group. These fatty acids include, principally, lauric acid, stearic acid, oleic acid, myristic acid, palmitic acid, linoleic acid, linolenic acid, behenic acid, or a mixture of such acids such as are obtained from the hydrolysis of tall oil, sperm oil, and other commercial fats. The acids should contain at least about 12 aliphatic carbon atoms, preferably from about 16 to about 30 carbon atoms.

Supplemental Additives

The explosive compositions of the invention typically contain other supplemental additives such as sensitizing components, supplemental oxygen-supplying salts, particulate light metals, particulate solid explosives, soluble and partly soluble self-explosives, explosive oils and the like for purposes of augmenting the strength and sensitivity or decreasing the cost of the explosive composition.

The sensitizing components are distributed substantially homogeneously throughout the explosive composition and are typically in the form of dispersed gas bubbles or voids. These sensitizing components include occluded gas bubbles which may be introduced in the form of glass or resin microspheres or other gas-containing particulate materials. They also include hollow glass or resin microspheres. Gas bubbles which are generated in-situ by adding to the composition and distributing therein a gas-generating material such as, for example, an aqueous solution of sodium nitrite, can also be used. Other suitable sensitizing components which may be employed alone or in addition to the foregoing include insoluble particulate solid self-explosives such as, for example, grained or flaked TNT, DNT, RDX and the like and water-soluble and/or hydrocarbon-soluble organic sensitizers such as, for example, amine nitrates, alkanolamine nitrates, hydroxyalkyl nitrates, and the like. The explosive compositions of the present invention may be formulated for a wide range of applications. Any combination of sensitizing components may be selected in order to provide an explosive composition of virtually any desired density, weight-strength or critical diameter.

The quantity of solid self-explosive ingredients and of water-soluble and/or hydrocarbon-soluble organic sensitizers may comprise up to about 40% by weight of the total explosive composition. The volume of the occluded gas component may comprise up to about 50% of the volume of the total explosive composition.

Optional additional materials may be incorporated in the explosive compositions of the invention in order to further improve sensitivity, density, strength, rheology and cost of the final explosive. Typical of materials found useful as optional additives include, for example, highly chlorinated paraffinic hydrocarbons, particulate oxygen-supplying salts such as prilled ammonium nitrate, calcium nitrate, perchlorates, and the like, particulate metal fuels such as aluminum, silicon and the like, particulate non-metal fuels such as sulfur, gilsonite and the like, particulate inert materials such as sodium chloride, barium sulphate and the like, water phase or hydrocarbon phase thickeners such as guar gum, polyacrylamide, carboxymethyl or ethyl cellulose, biopolymers, starches, elastomeric materials, and the like, crosslinkers for the thickeners such as potassium pyroantimonate and the like, buffers or pH controllers such as sodium borate, zinc nitrate and the like, crystals habit modifiers such as alkyl naphthalene sodium sulphonate and the like, liquid phase extenders such as formamide, ethylene glycol and the like and bulking agents and additives of common use in the explosives art.

The quantities of optional additional materials used may comprise up to about 50% by weight of the total explosive composition, the actual quantities employed depending upon their nature and function.

Preparation of the Explosive Compositions

A preferred method for making the water-in-oil explosive emulsions of the invention comprises the steps of (1) mixing water, inorganic oxidizer salts (e.g., ammonium nitrate) and, in certain cases, some of the supplemental water-soluble compounds, in a first premix, (2) mixing the water-immiscible organic liquid, the nitrogen-containing emulsifier of the invention and any other optional oil-soluble compounds, in a second premix and (3) adding the first premix to the second premix in a suitable mixing apparatus, to form a water-in-oil emulsion. The first premix is heated until all the salts are completely dissolved and the solution may be filtered if needed in order to remove any insoluble residue. The second premix is also heated to liquefy the ingredients. Any type of apparatus capable of either low or high shear mixing can be used to prepare these water-in-oil emulsions. Glass microspheres, solid self-explosive ingredients such as particulate TNT, solid fuels such as aluminum or sulfur, inert materials such as barytes or sodium chloride, undissolved solid oxidizer salts and other optional materials, if employed, are added to the emulsion and simply blended until homogeneously dispersed throughout the composition.

The water-in-oil explosive emulsions of the invention can also be prepared by adding the second premix liquefied organic solution phase to the first premix hot aqueous solution phase with sufficient stirring to invert the phases. However, this method usually requires substantially more energy to obtain the desired dispersion than does the preferred reverse procedure. Alternatively, these water-in-oil explosive emulsions are particularly adaptable to preparation by a continuous mixing process where the two separately prepared liquid phases are pumped through a mixing device wherein they are combined and emulsified.

The melt-in-oil emulsions can be formed by the steps of forming a melt comprising the oxygen-supplying component (e.g., ammonium nitrate), forming a homogeneous liquid mixture of the water-immiscible organic liquid and the nitrogen-containing emulsifier of the invention, adding the melt to the organic liquid mixture, and agitating the mixture to form an emulsion.

Prior to adding the melt to the organic liquid mixture, the melt may be formed by heating a premix of the oxygen-supplying component and a compound which together with the oxygen-supplying component forms a melt at a temperature which is lower than the melting point of the oxygen-supplying component, a premix of the water-immiscible organic liquid and the nitrogen-containing emulsifier of the invention also being heated, the heating of the premixes being to a temperature at which they are homogeneous liquids of a suitable viscosity for forming the emulsion. The melt is then preferably added slowly to the organic liquid mixture with vigorous agitation, which agitation is then continued, with cooling, when it is desired to disperse air bubbles or hollow particulate sensitizing agents into the explosive composition. The composition may then be inserted into, for example, wax-coated paper shells or low density polyethylene "lay flat" sleeves.

Illustrative explosive emulsion formulations within the.scope of the invention are disclosed in the following table. With each formulation, the oxidizer phase components (i.e., ammonium nitrate, sodium nitrate, and, if used, urea and water) are mixed. together at 130° C. The oil phase components (i.e., nitrogen-containing emulsifier from Example XXXI, mineral oil, and, if used, paraffin wax and microcrystalline wax) are also mixed together at 130° C. The oxidizer phase is added to the oil phase using a laboratory mixer to effect emulsification. The mixer is set at 70% of maximum power during emulsification and at full power for about one minute after emulsification is completed. The glass microballoons are then blended into the emulsion using the laboratory mixer. In the following table, all numerical values are in parts by weight.

TABLE

| | A | B | C | D | E |
|---|---|---|---|---|---|
| Product of Example XXXI | 4.51 | 3.90 | 3.90 | 3.90 | 3.90 |
| Ammonium Nitrate | 62.02 | 62.67 | 62.67 | 62.67 | 62.67 |
| Sodium Nitrate | 14.51 | 14.66 | 14.66 | 14.66 | 14.66 |
| Urea | 12.53 | 12.66 | 12.66 | 12.66 | 12.66 |
| Water | — | — | — | — | — |
| Paraffin Wax | — | — | — | 0.79 | — |
| Microcrystalline Wax | — | — | — | 0.79 | — |
| Mineral Oil | 2.41 | 2.10 | 2.10 | 0.52 | 2.10 |
| Glass microballoons (Grade C15/250 supplied by 3M) | 4.02 | 4.00 | 4.00 | 4.00 | 4.00 |

| | F | G | H | I |
|---|---|---|---|---|
| Product of Example XXXI | 3.90 | 3.90 | 3.90 | 3.24 |
| Ammonium Nitrate | 59.90 | 60.60 | 61.90 | 84.02 |
| Sodium Nitrate | 12.10 | 12.30 | 12.50 | 5.00 |
| Urea | 14.00 | 14.20 | 14.50 | — |
| Water | 4.00 | 3.00 | 1.00 | 4.00 |
| Paraffin Wax | — | — | — | — |
| Microcrystalline Wax | — | — | — | — |
| Mineral Oil | 2.10 | 2.10 | 2.10 | 1.44 |
| Glass microballoons (Grade C15/250 supplied by 3M) | 4.00 | 4.00 | 4.00 | 2.30 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An explosive composition comprising a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent, (B) at least one polyamine, and (C) at least one acid or acid producing compound capable of forming at least one salt with said polyamine, component (B) being bonded to component (C) through at least one salt linkage.

2. The composition of claim 1 wherein said acylating agent (A) comprises at least one mono- or polycarboxylic acid or acid-producing compound.

3. The composition of claim 1 wherein said acylating agent (A) comprises at least one monocarboxylic acid or acid-producing compound.

4. The composition of claim 1 wherein said acylating agent (A) comprises at least one fatty acid containing at least about 12 carbon atoms.

5. The composition of claim 1 wherein said acylating agent (A) comprises at least one polycarboxylic acid or acid-producing compound.

6. The composition of claim 1 wherein said acylating agent (A) comprises at least one hydrocarbyl-substituted carboxylic acid or acid-producing compound.

7. The composition of claim 1 wherein said acylating agent (A) comprises at least one hydrocarbyl-substituted carboxylic acid or anhydride, the hydrocarbyl substituent of said acid or anhydride having an average of at least about 10 aliphatic carbon atoms.

8. The composition of claim 1 wherein said acylating agent (A) comprises at least one hydrocarbyl-substituted carboxylic acid or anhydride, the hydrocarbyl substituent of said acid or anhydride having an average of at least about 30 aliphatic carbon atoms.

9. The composition of claim 1 wherein said acylating agent (A) comprises at least one hydrocarbyl-substituted carboxylic acid or anhydride, the hydrocarbyl substituent of said acid or anhydride having an average of at least about 50 aliphatic carbon atoms.

10. The composition of claim 1 wherein said acylating agent (A) comprises at least one hydrocarbyl-substituted succinic acid or acid-producing compound.

11. The composition of claim 1 wherein said acylating agent (A) comprises at least one polyisobutenyl-substituted succinic acid or anhydride.

12. The composition of claim 1 wherein said polyamine has at least two amino groups, at least one of said amino groups being a primary or secondary amino group, and at least one of said amino groups being a primary, secondary or tertiary amino group.

13. The composition of claim 1 wherein said polyamine is aliphatic, cycloaliphatic, aromatic or heterocyclic.

14. The composition of claim 1 wherein said polyamine is a polyalkylene polyamine, branched polyalkylene polyamine, polyoxyalkylene polyamine or hydrocarbyl-substituted polyamine.

15. The composition of claim 1 wherein said polyamine is hydrazine or a substituted hydrazine.

16. The composition of claim 1 wherein said polyamine is a compound represented by the formula $$H-\underset{\underset{R}{|}}{N}\left(\text{Alkylene-}\underset{\underset{R}{|}}{N}\right)_n R$$

wherein: n is a number in the range of from 1 to about 10; each R is independently a hydrogen atom, a hydrocarbyl group having up to about 700 carbon atoms or a hydroxy-substituted hydrocarbyl group having up to about 700 carbon atoms, and Alkylene is an alkylene group having from 1 to about 18 carbon atoms.

17. The composition of claim 16 wherein each R independently has an average of up to about 30 carbon atoms.

18. The composition of claim 16 wherein n is a number in the range of from 1 to about 7.

19. The composition of claim 16 wherein Alkylene has from 1 to about 4 carbon atoms.

20. The composition of claim 16 wherein Alkylene is ethylene.

21. The composition of claim 1 wherein said polyamine comprises diethylene triamine, triethylene tetramine, tetraethylene pentamine, pentaethylene hexamine or a mixture of two or more thereof.

22. The composition of claim 1 wherein said polyamine comprises at least one aliphatic polyamine containing at least one polymer chain having a molecular weight of from about 500 to about 10,000 attached to a nitrogen and/or to a carbon of an alkylene group containing an amino nitrogen atom.

23. The composition of claim 1 wherein said polyamine is a compound represented by the formula $$R'-\underset{\underset{R'}{|}}{N}\left(\text{Alkylene-}\underset{\underset{R''}{|}}{N}\right)_n R''$$

wherein R′ is hydrogen or a polyolefin having a molecular weight in the range of from about 500 to about 10,000, R″ is hydrogen or a lower alkyl group, with the proviso that at least one of R″ or R′ is hydrogen and at least one of R′ is said polyolefin, Alkylene is an alkylene group of from 1 to about 18 carbon atoms, and n is a number in the range of from 1 to about 10.

24. The composition of claim 23 wherein one of R′ is a branched chain polymer having a molecular weight in the range of from about 500 to about 5000, and the other R′ is hydrogen.

25. The composition of claim 23 wherein one of R′ is polypropylene or polyisobutylene having a molecular weight in the range of from about 600 to about 1300 and the other R′ is hydrogen.

26. The composition of claim 1 wherein said acid (C) comprises at least one mineral acid or organic acid.

27. The composition of claim 1 wherein said acid (C) comprises at least one carboxylic acid or acid-producing compound.

28. The composition of claim 1 wherein said acid (C) comprises at least one monocarboxylic acid or acid-producing compound.

29. The composition of claim 1 wherein said acid (C) comprises at least one fatty acid containing at least about 12 carbon atoms.

30. The composition of claim 1 wherein said acid (C) comprises at least one fatty acid derived from tall oil.

31. The composition of claim 1 wherein said acid (C) comprises at least one polycarboxylic acid or acid-producing compound.

32. The composition of claim 1 wherein said acid (C) comprises at least one hydrocarbyl-substituted carboxylic acid or acid-producing compound.

33. The composition of claim 1 wherein said acid (C) comprises at least one hydrocarbyl-substituted carboxylic acid or anhydride, the hydrocarbyl substituent of said acid or anhydride having an average of at least about 10 aliphatic carbon atoms.

34. The composition of claim 1 wherein said acid (C) comprises at least one hydrocarbyl-substituted carboxylic acid or anhydride, the hydrocarbyl substituent of said acid or anhydride having an average of at least about 30 aliphatic carbon atoms.

35. The composition of claim 1 wherein said acid (C) comprises at least one hydrocarbyl-substituted carboxylic acid or anhydride, the hydrocarbyl substituent of said acid or anhydride having an average of at least about 50 aliphatic carbon atoms.

36. The composition of claim 1 wherein said acid (C) comprises at least one hydrocarbyl-substituted succinic acid or acid-producing compound.

37. The composition of claim 1 wherein said acid (C) comprises at least one polyisobutenyl-substituted succinic acid or anhydride.

38. The composition of claim 1 wherein said acid (C) comprises at least one phosphorus acid, anhydride, ester or halide.

39. The composition of claim 1 wherein said acid (C) is a phosphorus, phosphinyl or phosphonyl acid or acid-producing compound.

40. The composition of claim 1 wherein said acid (C) comprises at least one oxyphosphorus acid, thiophosphorus acid, oxythiophosphorus acid, dialkylphosphoric acid or diarylphosphinic acid.

41. The composition of claim 1 wherein said acid (C) at least one phosphoromonothioic acid, phosphorodithioic acid, phosphorotrithioic acid or phosphorotetrathioic acid.

42. The composition of claim 1 wherein said acid (C) comprises at least one sulfonic acid.

43. The composition of claim 1 wherein said acid (C) comprises at least one compound represented by the formula $$R^1(SO_3H)_r$$

wherein $R^1$ is a hydrocarbyl group containing up to about 60 carbon atoms and r is a number ranging from 1 to about 4.

44. The composition of claim 1 wherein said acid (C) comprises at least one compound represented by the formula $$R^2{}_xT(SO_3H)_y$$

wherein $R^2$ is a hydrocarbyl group of about 4 to about 60 carbon atoms, T is a cyclic nucleus, x is a number ranging from 1 to about 3, and y is a number ranging from 1 to about 4.

45. The composition of claim 1 wherein said acid (C) is nitric acid, nitrous acid, sulfuric acid, sulfurous acid, hydrochloric acid, silicic acid, boric acid, perchloric acid, chloric acid, chlorous acid, hypochlorous acid, permanganic acid, chromic acid, dichromic acid, hydrofluoric acid, hydrobromic acid, hydriodic acid, hydrosulfuric acid or a mixture of two or more thereof.

46. The composition of claim 1 wherein said oxygen-supplying component comprises ammonium nitrate.

47. The composition of claim 1 wherein said discontinuous phase further comprises water.

48. The composition of claim 1 wherein said discontinuous phase is present in said explosive composition at a level of at least about 85% by weight of said explosive composition.

49. The composition of claim 1 wherein said continuous phase is present in said explosive composition at a level of from about 2% to about 15% by weight of said explosive composition.

50. The composition of claim 1 wherein said emulsifier is present in said explosive composition at a level in the range of from about 4% to about 40% by weight, based on the weight of said continuous phase.

51. A water-in-oil explosive emulsion comprising: a discontinuous oxidizer phase comprising water and at least one oxygen-supplying component, said oxygen-supplying component being present at a level in the range of about 70% to about 95% by weight based on the weight of said oxidizer phase, said water being present at a level in the range of about 5% to about 30% by weight based on the weight of said oxidizer phase; a continuous phase comprising at least one water-immiscible organic liquid; and an emulsifying amount of at least one emulsifier derived from (A) at least one carboxylic acylating agent,
(B) at least one polyamine, and
(C) at least one acid or acid producing compound capable of forming at least one salt with said polyamine, component (B) being bonded to component (C) through at least one salt linkage.

52. A melt-in-oil explosive emulsion comprising: a discontinuous oxidizer phase comprising at least one oxygen-supplying component, and up to about 5% by weight based on the weight of said oxidizer phase of water; a continuous phase comprising at least one water-immiscible organic liquid; and an emulsifying amount of at least one emulsifier derived from (A) at least one carboxylic acylating agent,
(B) at least one polyamine, and
(C) at least one acid or acid producing compound capable of forming at least one salt with said polyamine, component (B) being bonded to component (C) through at least one salt linkage.

53. An explosive composition comprising a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one polyisobutenyl succinic acid or anhydride,
(B) at least one polyamine, and
(C) at least one tall oil acid, component (B) being linked component (C) through at least one salt linkage.

* * * * *